US010828219B2

(12) United States Patent
Podolske

(10) Patent No.: US 10,828,219 B2
(45) Date of Patent: Nov. 10, 2020

(54) METHODS FOR SUPPORTING URNS

(71) Applicant: Serenity Products, LLC, Missoula, MT (US)

(72) Inventor: Dawn Podolske, Missoula, MT (US)

(73) Assignee: Serenity Products, LLC, Missoula, MT (US)

( * ) Notice: Subject to any disclaimer, the term of this patent is extended or adjusted under 35 U.S.C. 154(b) by 326 days.

(21) Appl. No.: 15/476,860

(22) Filed: Mar. 31, 2017

(65) Prior Publication Data

US 2017/0281449 A1 Oct. 5, 2017

Related U.S. Application Data

(60) Provisional application No. 62/316,790, filed on Apr. 1, 2016.

(51) Int. Cl.
*A61G 17/08* (2006.01)

(52) U.S. Cl.
CPC ..... *A61G 17/08* (2013.01)

(58) Field of Classification Search
CPC ..... A61G 17/08; A61G 17/045; A47G 7/041; A01G 5/04; A47F 7/283; F16M 11/2014; F16M 2200/08; A47B 1/04; A47B 1/08; A47B 3/06
USPC ..... 27/1, 19; 211/85.27, 85.16; 248/27.8, 248/346.03; 47/39; 108/50.11, 69, 90
See application file for complete search history.

(56) References Cited

U.S. PATENT DOCUMENTS 2,472,903 A * 6/1949 Kamholtz ..... A47B 1/02 108/69
2,737,746 A * 3/1956 Orr ..... A01G 5/04 24/5
2,917,256 A * 12/1959 Dixon ..... A01G 5/04 211/13.1
3,131,897 A * 5/1964 Shelker ..... A61G 17/04 248/206.5
3,869,993 A * 3/1975 Edlund ..... A47B 91/005 108/101
4,199,848 A 4/1980 Kohnert
D258,125 S * 2/1981 Bailey ..... D11/157
D304,641 S * 11/1989 Bourassa ..... D99/5
5,172,457 A 12/1992 Allen et al.
D334,642 S * 4/1993 Allen ..... D99/5
D341,467 S * 11/1993 Allen ..... D99/5
5,709,441 A 1/1998 Bartling et al.
5,987,814 A * 11/1999 Ray ..... A61G 17/045 47/41.12
6,044,532 A 4/2000 Bowling et al.
6,254,152 B1 * 7/2001 Tillett ..... A61G 17/08 108/12
6,520,093 B1 * 2/2003 Merl ..... A47B 1/04 108/69
6,543,103 B1 4/2003 Robert
6,691,385 B2 2/2004 Bell et al.
6,775,886 B2 8/2004 Ogle, II
7,191,498 B2 3/2007 Fischer
7,987,564 B2 8/2011 Leeder
(Continued)

*Primary Examiner* — William L Miller
(74) *Attorney, Agent, or Firm* — Wells St. John P.S.

(57) ABSTRACT

This disclosure includes a support structure for an urn. The support structure includes a base with a surface. At least one attachment device extends from the surface of the base and a support surface is over the base and configured to support an urn.

3 Claims, 36 Drawing Sheets

(56) References Cited

U.S. PATENT DOCUMENTS

| | | | | |
|---|---|---|---|---|
| 8,046,881 | B2 | 11/2011 | Johnson et al. | |
| 8,136,459 | B2 * | 3/2012 | Buckland | A47B 13/10 108/69 |
| 8,230,561 | B2 | 7/2012 | Courchesne | |
| 8,256,356 | B2 * | 9/2012 | Fremming | A47B 37/00 108/139 |
| 8,485,112 | B1 * | 7/2013 | Madden | A47B 13/086 108/90 |
| 8,689,412 | B2 * | 4/2014 | Grover | A61G 21/00 108/50.11 |
| 8,943,657 | B1 | 2/2015 | Perry et al. | |
| 2002/0148084 | A1 | 10/2002 | Bell et al. | |
| 2002/0170470 | A1 * | 11/2002 | Cheng | B60N 3/002 108/69 |
| 2003/0115728 | A1 | 6/2003 | Robert | |
| 2004/0035988 | A1 | 2/2004 | Skalka | |
| 2004/0040128 | A1 | 3/2004 | Ogle, II | |
| 2005/0055812 | A1 | 3/2005 | Fischer | |
| 2005/0246877 | A1 | 11/2005 | Davis et al. | |
| 2008/0078074 | A1 | 4/2008 | McCampbell | |
| 2010/0139060 | A1 | 6/2010 | Leeder | |
| 2011/0099778 | A1 | 5/2011 | Johnson et al. | |
| 2013/0305502 | A1 * | 11/2013 | Weder | A01G 5/04 27/1 |
| 2017/0281449 | A1 * | 10/2017 | Podolske | A61G 17/08 |

* cited by examiner

METHODS FOR SUPPORTING URNS

CROSS REFERENCE TO RELATED APPLICATION

This application claims priority from U.S. Provisional Patent Application 62/316,790 filed Apr. 1, 2016, the disclosure of which is incorporated herein by reference.

TECHNICAL FIELD

This invention relates to support structures for Cremation containers such as urns, other funeral display accessories and celebration displays such as weddings and Bar Mitzvahs.

BACKGROUND OF THE DISCLOSURE

"The cremation rate in the United States has been increasing steadily with the national average rate rising from 3.56% in 1960 to 40.62% in 2010 and projections from the Cremation Association of North America forecasting a rate of 44.42% in 2015 and 55.65% in 2025." *List of countries by cremation rate*, Wikipedia, citing "*Trends and Statistics*," National Funeral Directors Association, 2011 retrieved 2012-04-22 and "*Industry Statistical Information*," Cremation Association of North America, 2010, retrieved 2012-04-22. With the increase in cremation rate is a corresponding increase in families desiring to honor their loved one with a memorial service. However, the families are in a quandary as to how to best present the deceased in an appropriate service.

With the substitution of funeral urns (also called cinerary urns and burial urns) for coffins, traditional funerals can proceed as they always have, complete with a viewing period, followed by a service conducted by a pastor and a graveside service near the area where, just as a coffin, the funeral urn is be buried, if desired. Consequently, there is a need for a solution for presenting the cremation of a loved one in the dignified and respectful manner that the ceremony warrants.

While the inventions were motivated for addressing/designing for the above-stated issues, it is in no way so limited. Other aspects and implementations are contemplated.

BRIEF DESCRIPTION OF THE DRAWINGS

Embodiments of the disclosure are described below with reference to the following accompanying drawings.

DETAILED DESCRIPTION OF THE EMBODIMENTS

This disclosure is submitted in furtherance of the constitutional purposes of the U.S. Patent Laws "to promote the progress of science and useful arts" (Article 1, Section 8).

Figure 1:
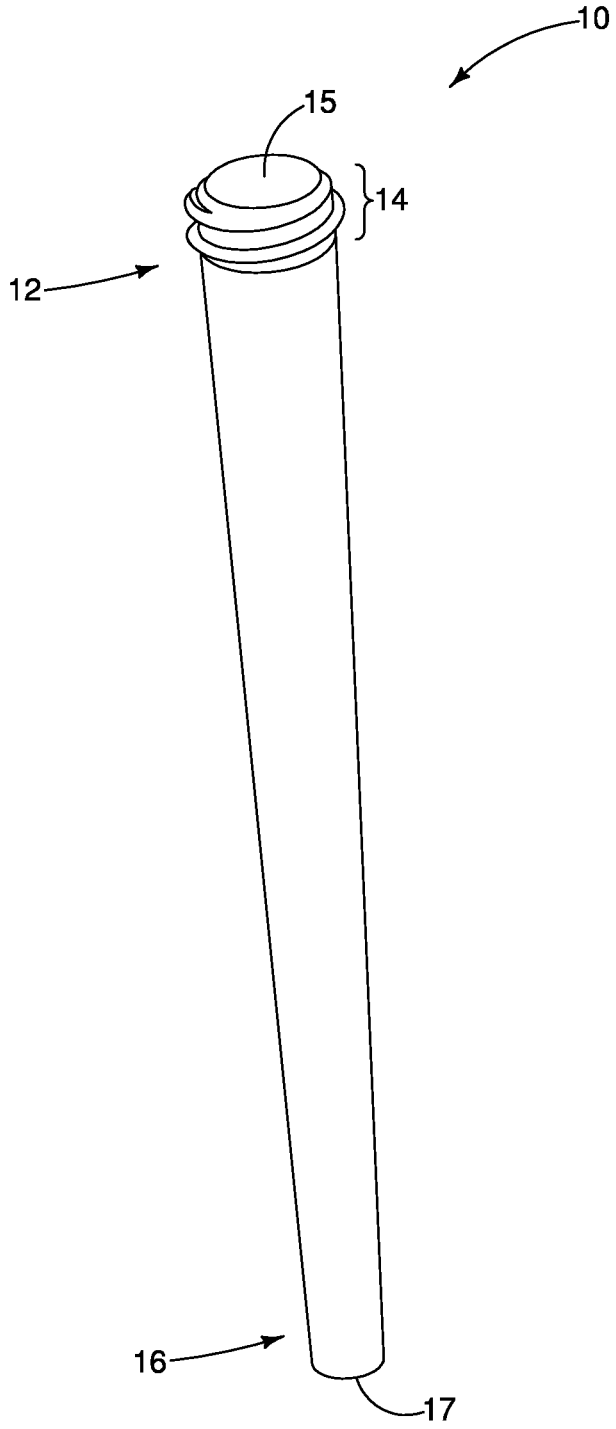
FIG. 1 is a perspective view of a leg for exemplary support structures according to various embodiments of the invention.
Figure 2A:
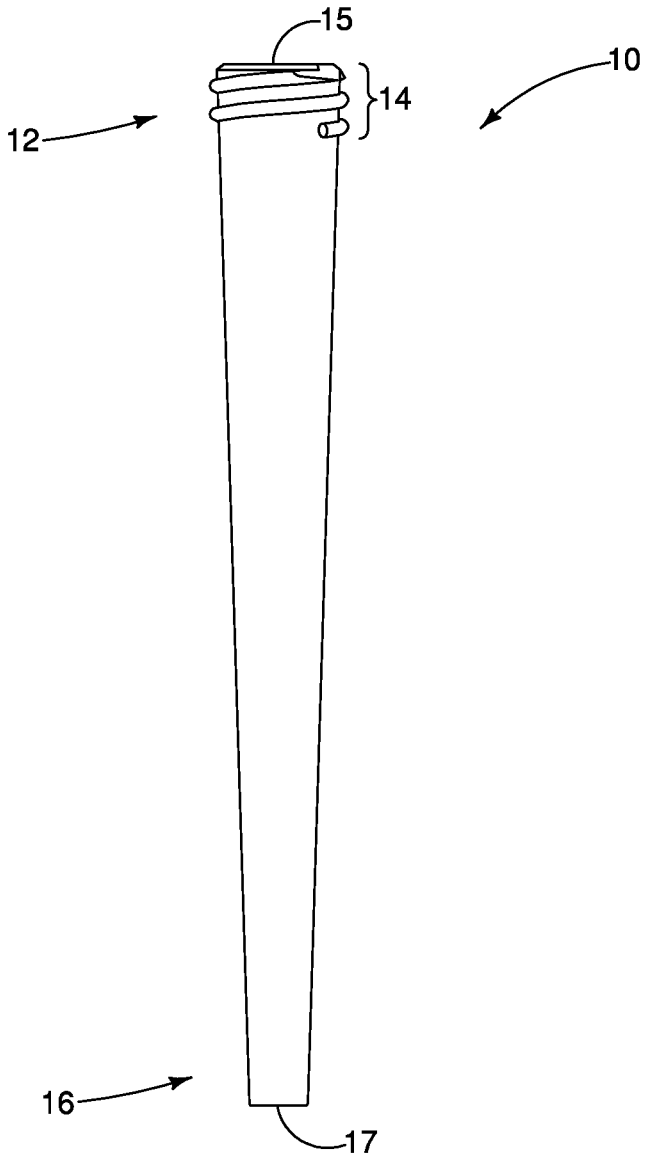
FIGS. 2A and 2B are side views of the leg of FIG. 1.
Figure 2B:
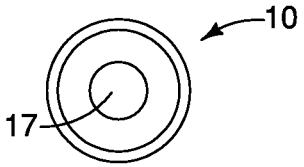

FIGS. 1, 2A and 2B illustrate exemplary legs 10 for exemplary support structures for urns (discussed subsequently) according to one embodiment of the invention. An exemplary leg 10 has a circular cross-section configuration that tapers from a top portion 12 to a smallest diameter at a bottom portion 16 of the leg 10. Other cross-section configurations are contemplated, for example, a square, an oval, a rectangle, a hexagon, and a parallelogram. Other taper configurations are contemplated, for example, the smallest diameter could be located at the top portion 12 of the leg 10.

Still referring to FIGS. 1, 2A and 2B, the top portion 12 of leg 10 has threads 14 for threading into other components (discussed subsequently) of exemplary support structures. However, it should be understood that other methods of securing or attaching legs (selectively attached and selectively detached) to components of exemplary support structures are contemplated. For example, legs 10 can be snapped into other components of exemplary support structures. Still further, legs 10 can be removably secured onto, or removably secured into respective openings of other components of exemplary support structures. Referring to threads 14 again, exemplary threads 14 of legs 10 are configured as Modified ½ inch-13 UNC; Class 2B, Custom Oval Threads. Other configurations for threads 14 are contemplated. Exemplary threads 14 include a chamfer of 0.02 inch×45 degrees. Other exemplary chamfer configurations for threads 14 are contemplated.

An exemplary diameter for the top surface 15 of leg 10 is 0.42 inch and an exemplary diameter for the bottom surface 17 is 0.20 inch. Other exemplary diameters are contemplated for respective top 15 and bottom 17 surfaces. An exemplary length for leg 10 is 3.75 inches and other length dimensions are contemplated. For example, other exemplary lengths include 0.5 inch, 1.0 inch. 1.5 inch, 2 inches, 2.5 inches, 3.0 inches, etc., and any length dimension in between these lengths. The bottom surface 17 of legs 10 is illustrated as a planar surface. However, the planar surface of bottom surface 17 can include grooves, ribs and ridges to increase friction. Additionally, the bottom portion 16 of legs 10 can be covered by rubber or plastic coverings. The terminal end of bottom portions 16 of legs 10 can rest upon another surface or ultimately be inserted into a foam structure such as wet or silk/dry floral foam used in floral and funeral displays.

An exemplary leg 10 is composed of plastic and produced by a method of plastic injection molding. Exemplary plastics include thermoplastics, thermosetting plastics and similar materials which can be characterized as being ductile and/or malleable which provides the capability of being molded into various forms and then hardened, ultimately to be configured as a leg 10. Furthermore, these plastic materials can be generally characterized by any of various nonmetallic compounds, synthetically produced, usually from organic compounds by polymerization, or formed into pliable sheets or films, fibers, flexible or hard foams. Exemplary plastic materials include polystyrene, acrylonitrile butadiene styrene (ABS), polyamide, polypropylene, polyethylene, and polyvinyl chloride (PVC). Other exemplary nonmetallic compounds include spun glass or fiberglass which is a composite of extremely fine fibers of glass combined with polymers and epoxies.

Other compositions for leg 10 are contemplated such as metals or similar materials. Exemplary metals or similar material include tin, iron, aluminum, zinc, brass, gold, silver, bronze, copper, and alloys of any one metal or any combination of the metals such as steel, stainless steel, etc. The metals or similar material can be characterized as being ductile and/or malleable. Being ductile and malleable allows for the metal or similar material to be molded into various forms and then hardened, ultimately to be configured as a leg 10. Still further, exemplary legs 10 can be composed of wood or ceramic materials.

FIGS. 3A, 3B, 3C, 3D, 3E, 3F, 4, 5, 6, 7, 8 and 9 illustrate an exemplary support structure for urns and can be referred to as one example of an urn saddle 30. This urn saddle 30 is designed to accommodate circular urns, and therefore, will be referred to as a circular urn saddle 30 for distinction from other urn saddles disclosed in this document. The circular urn saddle 30 includes three legs 10 (as previously described with respect to FIGS. 1, 2A and 2B) and a support base 32 (or support surface) (support base 32 being the entire structure of the circular urn saddle 30 without the legs 10 (see FIGS. 3B, 3C, 3D, 3E and 3F)). Legs 10 are secured to an exterior bottommost surface 45 (see FIG. 5). While three legs 10 are shown, the circular urn saddle 30 can have more than three legs 10 such as four, five, six, etc. If legs 10 are to be permanently secured or permanently attached to the exterior bottommost surface 45 of support base 32 (see FIG. 5), such can be achieved with adhesives such as cements or glues. Alternatively, if legs 10 are to be removably secured or removably attached (and selectively detached) to the exterior bottommost surface 45 of support base 32 (see FIG. 6), such can be achieved by threading threads 14 of legs 10 into openings 43 in the exterior bottommost surface 45. Exemplary openings 43 are located equidistant in a circle which means for three openings that each will be 120 degrees separation between respective openings. Each opening has a diameter of 0.46 inch.

Referring to FIGS. 3A, 3B, 3C, 3D, 3E and F, support base 32 of circular urn saddle 30 is generally a circular structure having an interior bottommost surface 34. A first circular ridge 36 has a circumference and diameter that surrounds the interior bottommost surface 34 and extends upwardly from the interior bottommost surface 34. A second circular ridge 38 has a circumference and diameter, larger than the first circular ridge 36, that surrounds the first circular ridge 36 and extends upwardly from the first circular ridge 36. A third circular ridge 40 has a circumference and diameter, larger than the second circular ridge 38, that surrounds the second circular ridge 38 and extends upwardly from the second circular ridge 38. The third circular ridge 40 establishes the topmost surface of the circular urn saddle 30 and defines an exterior, outermost periphery edge 33 of circular urn saddle 30.

In one exemplary embodiment of the support base 32 of the circular urn saddle 30, first and second circular ridges 36/38 have a plurality of recesses 42 which can be referred to as notches. In one embodiment, first circular ridge 36 has four recesses 42 positioned equidistant around the perimeter of the first circular ridge 36 and second circular ridge 38 has four recesses 42 positioned equidistant around the perimeter of the second circular ridge 38. Each recess 42 has an exemplary depth dimension of 0.1 inch, an exemplary width dimension of 0.25 inch and an exemplary length dimension (in the diametric direction) of 0.38 inch. Other dimensions for the recesses 42 are contemplated. It should be understood that the positions of respective recesses in each circular ridge may have different locations other than being equidistant. Moreover, it should be further understood that a different number of respective recesses for each circular ridge is contemplated.

Figure 3A:
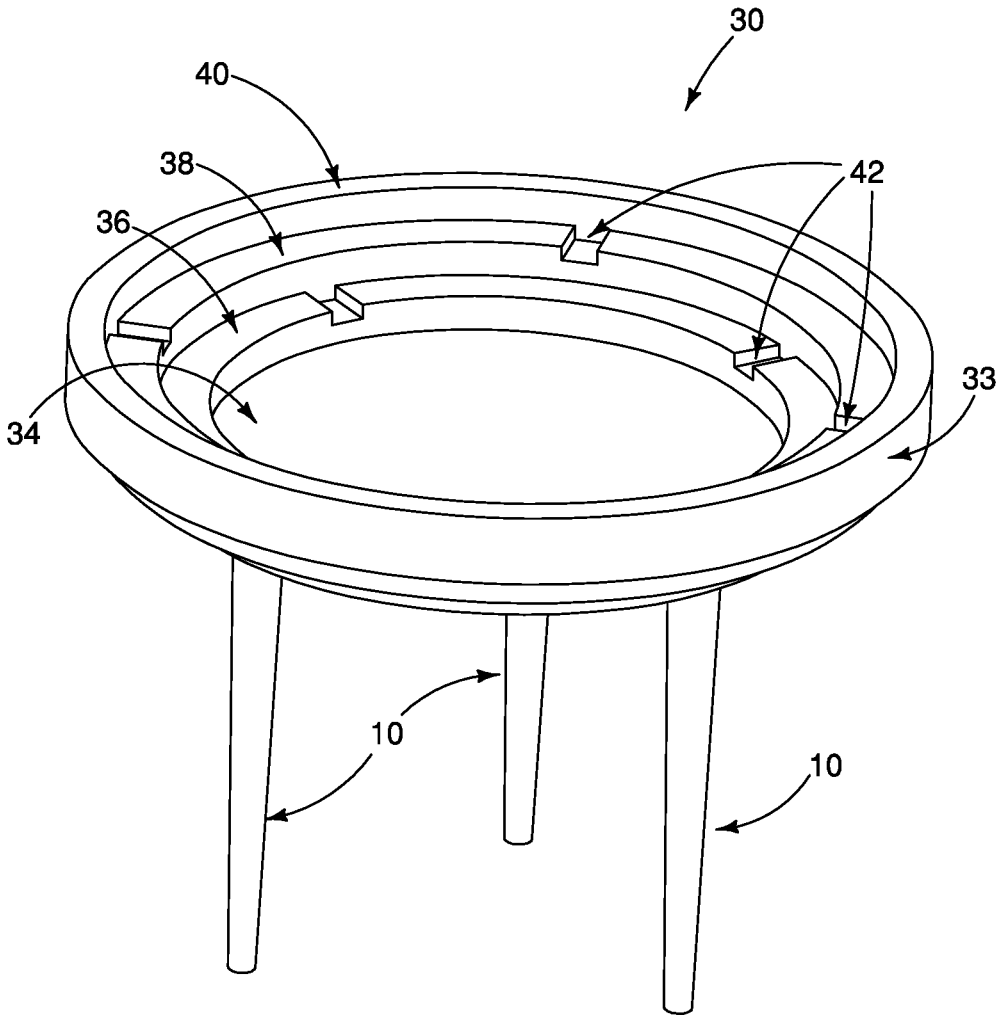
FIGS. 3A, 3B, 3C, 3D, 3E and 3F are various views of an exemplary embodiment of a support structure for an urn according to various embodiments of the invention.
Figure 3B:
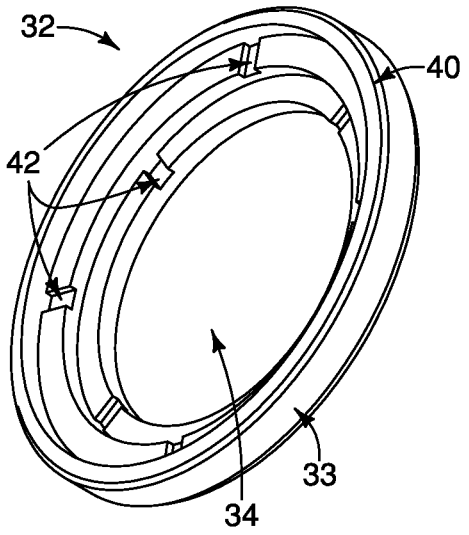
Figure 3C:
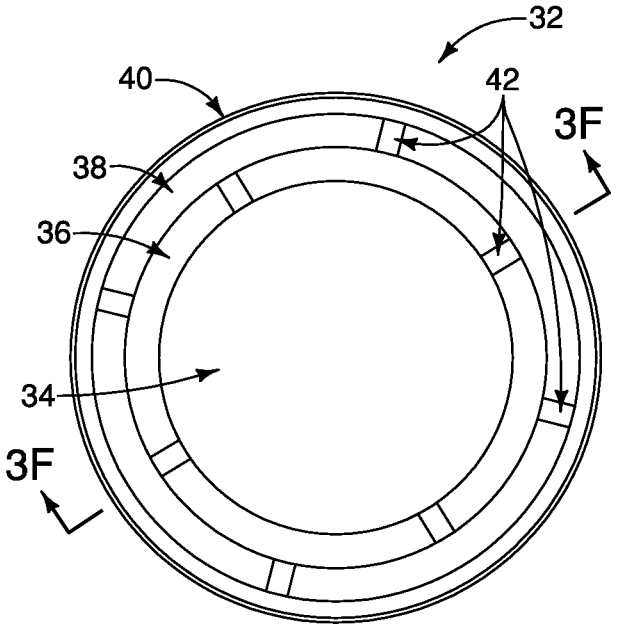
Figure 3E:
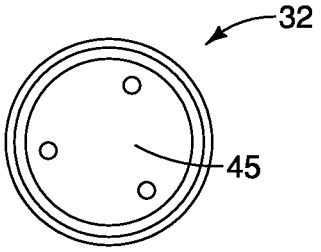
Figure 3D:
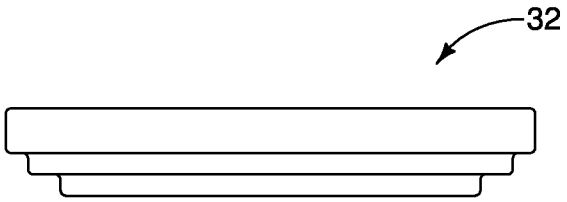
Figure 3F:
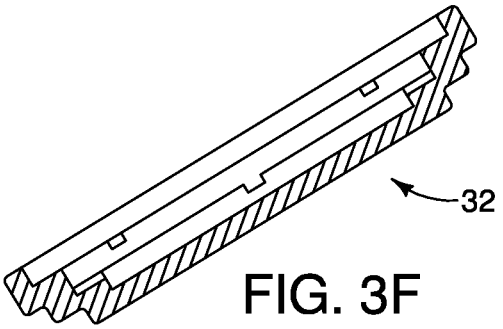
Figure 4:
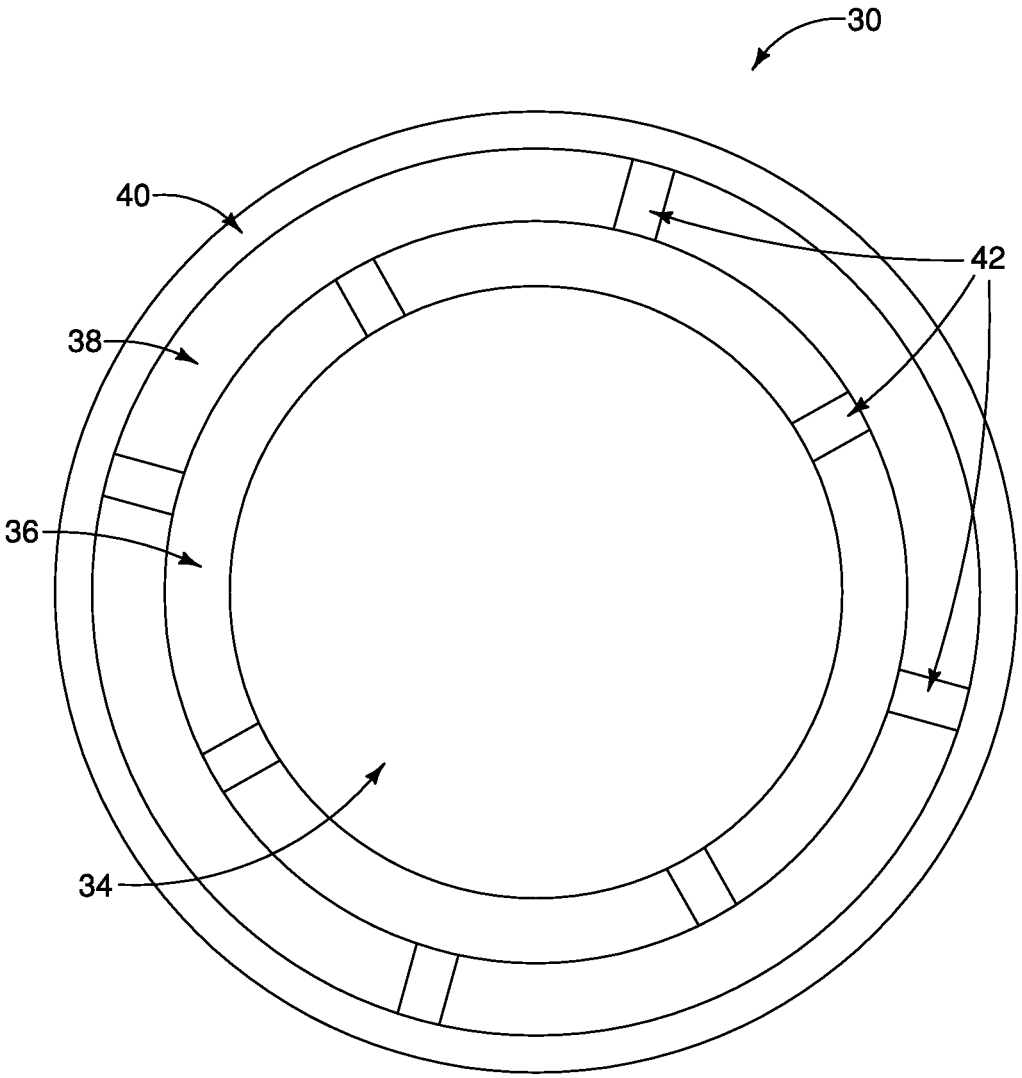
FIG. 4 is a top view of the support structure of FIGS. 3A, 3B, 3C, 3D, 3E and 3F.
Figure 5:
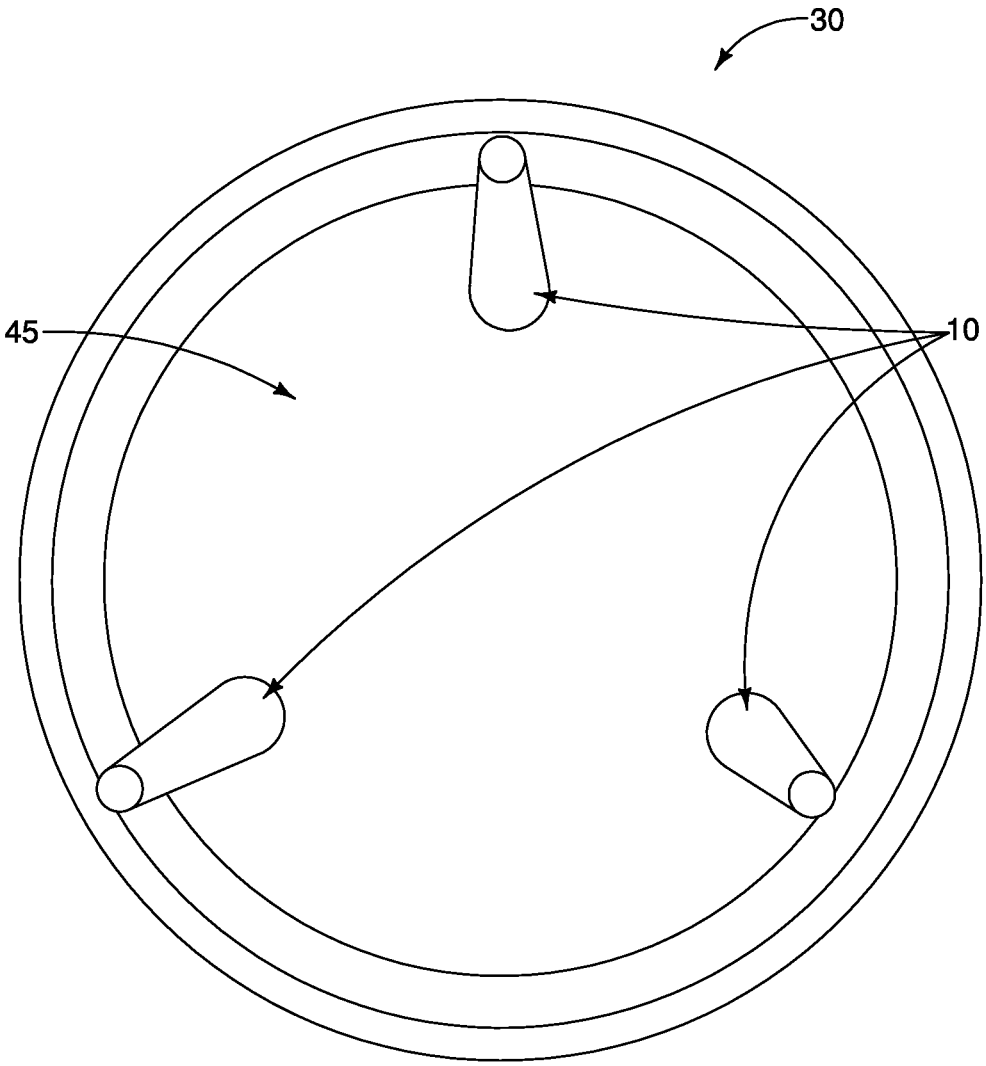
FIG. 5 is a bottom view of the support structure of FIGS. 3A, 3B, 3C, 3D, 3E and 3F.
Figure 6:
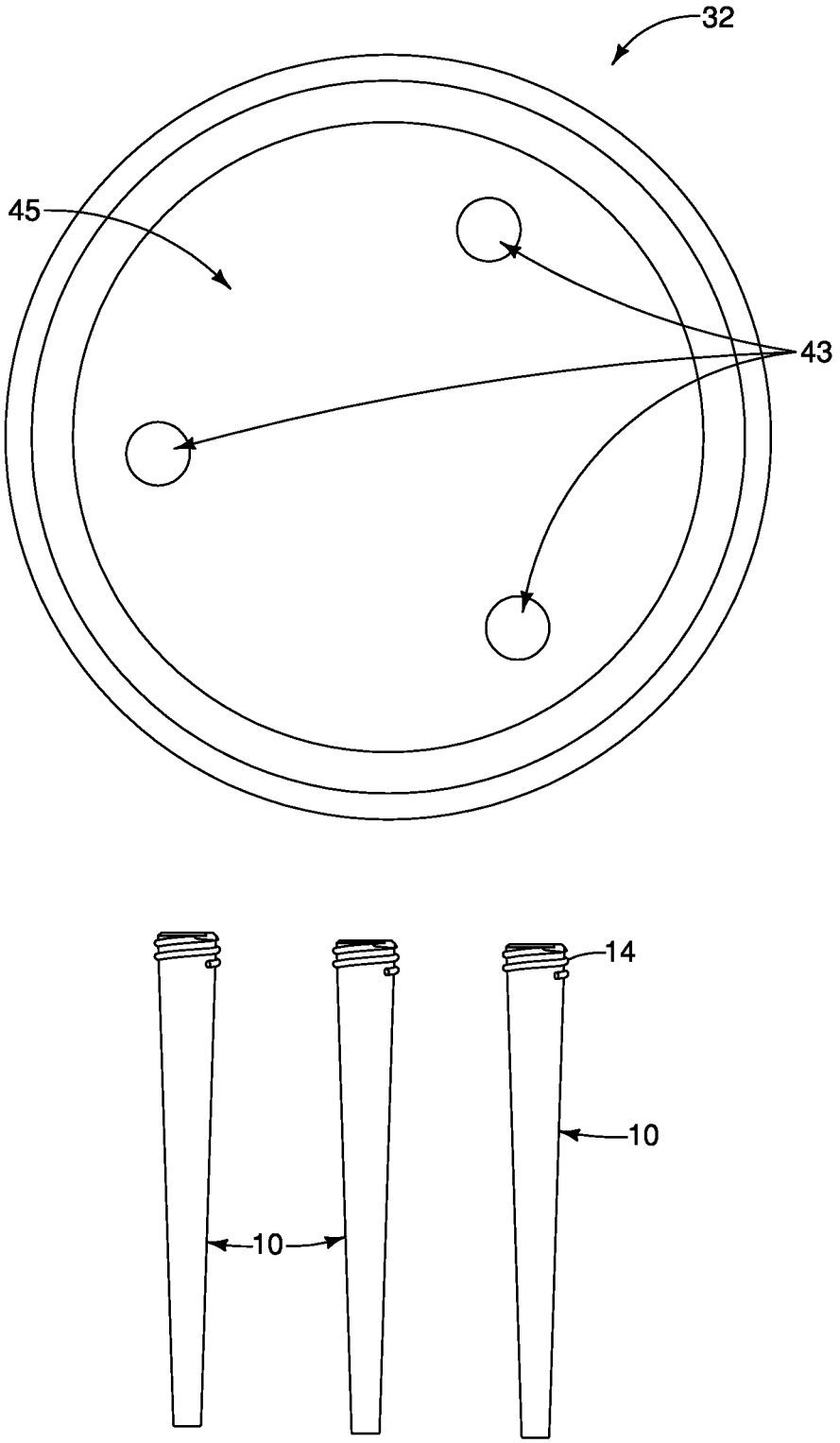
FIG. 6 is a view of components of the support structure of FIGS. 3A, 3B, 3C, 3D, 3E and 3F.

Still referring to the circular ridges of the circular urn saddles 30, each circular ridge increases in diameter as one proceeds elevationally upwardly from the interior bottommost surface 34. Exemplary dimensions include the interior bottommost surface 34 having a diameter of 4.0 inches defined by an inner periphery edge of the first circular ridge 36. The first circular ridge 36 has a diameter of 4.75 inches defined by an inner periphery edge of the second circular ridge 38. The second circular ridge 38 has a diameter of 5.50 inches defined by an inner periphery edge of the third circular ridge 40. The third circular ridge 40 has a diameter of 6.0 inches defined by the exterior, outermost periphery edge 33 of the circular urn saddle 30. Referring to FIGS. 3D and 3F, an exemplary embodiment of outermost periphery surfaces of support base 32 extending down and below the outermost periphery edge 33 includes a cascading configuration, that is, a step configuration. Similarly, an inside periphery of the support base 32 has a step configuration extending up from the interior bottommost surface 34 and established by the first, second and third circular ridges 36/38/40.

Figure 7:
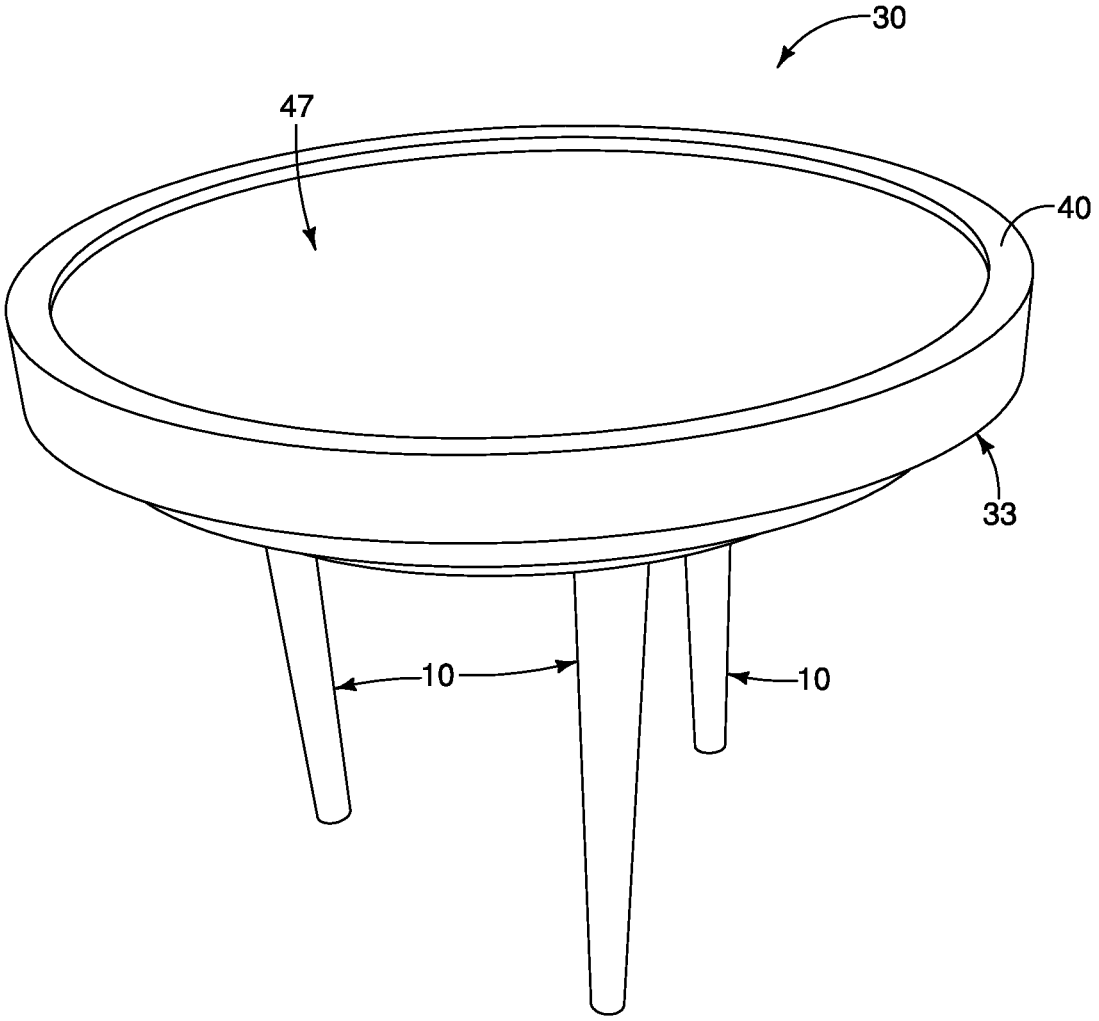
FIG. 7 is a perspective view of another exemplary embodiment of a support structure for an urn according to various embodiments of the invention.
Figure 8:
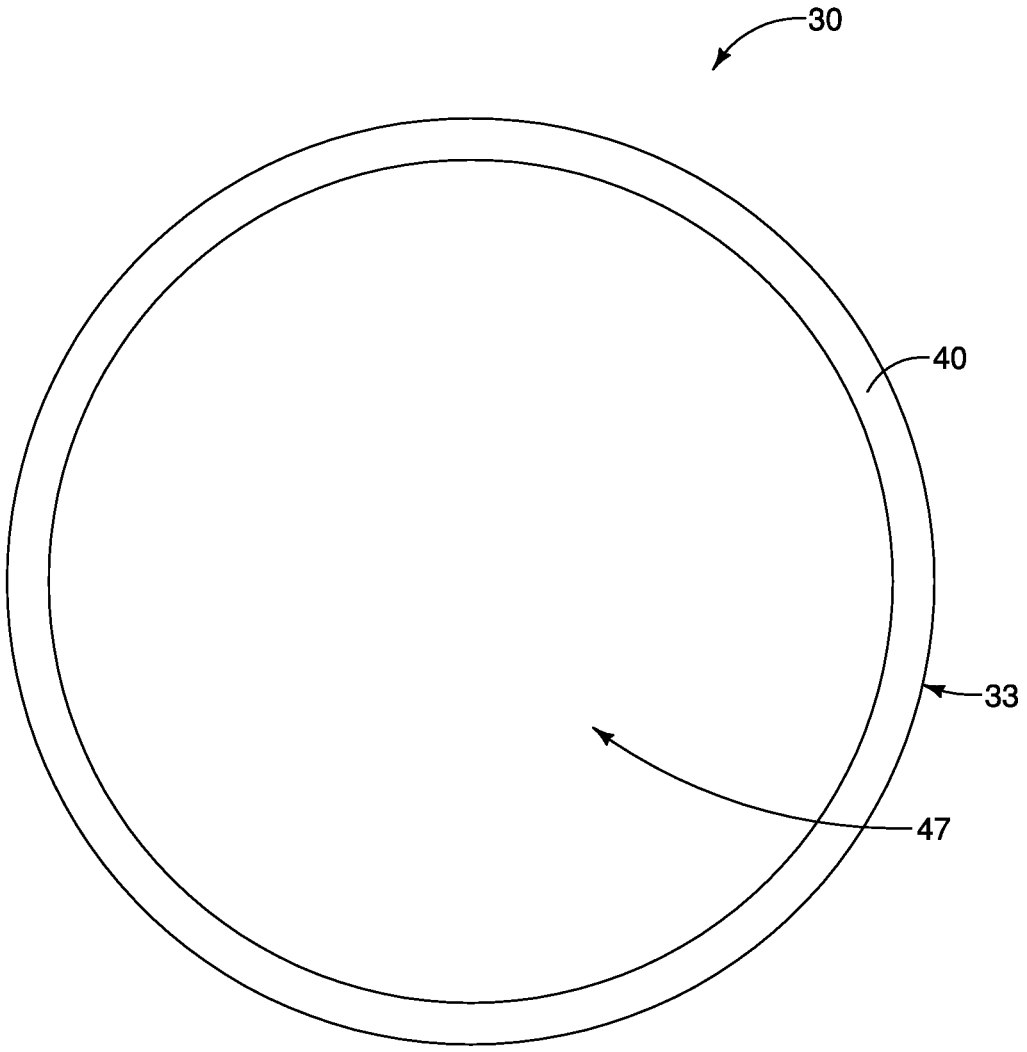
FIG. 8 is a top view of the support structure of FIG. 7

Referring to FIGS. 7-8, another embodiment of the circular urn saddle 30 is shown that includes circular plate or platform 47 positioned in the support base 32. This exemplary platform 47 is diametrically dimensioned to rest on top of the second circular ridge 38 inside the third circular ridge 40. Other platforms 47 having different diametric dimensions are contemplated. For example, a platform 47 can be dimensioned to rest on top of the interior bottommost surface 34 inside the first circular ridge 36. Alternatively, platform 47 can be dimensioned to rest on top of the first circular ridge 36 inside the second circular ridge 38. Extending from opposite sides of the platforms 47 are extensions (not shown in these views) configured to rest in the recesses 42 (notches) of circular ridges 36/38 in the support base 32. This cooperation between extensions of the platforms 47 and the circular ridges 36/38 prevents the platforms 47 from moving or twisting relative to the support base 32. The purpose of the platforms 47 is to provide a larger planar surface to support structures such as urns. That is, platforms 47 provide a more substantial support surface. Beneficial aspects of the platforms 47 as support surfaces are increased with the cooperation between extensions of the platforms 47 and the circular ridges 36/38.

It should be understood that an exemplary method of use for circular urn saddle 30 is to support an urn in a floral arrangement and/or funeral display. Accordingly, the circular ridges of the support base 32 accommodate urns of varying sizes. Circular urn saddles with support bases 32 having more, or less, than three circular ridges are contemplated.

Figure 9:
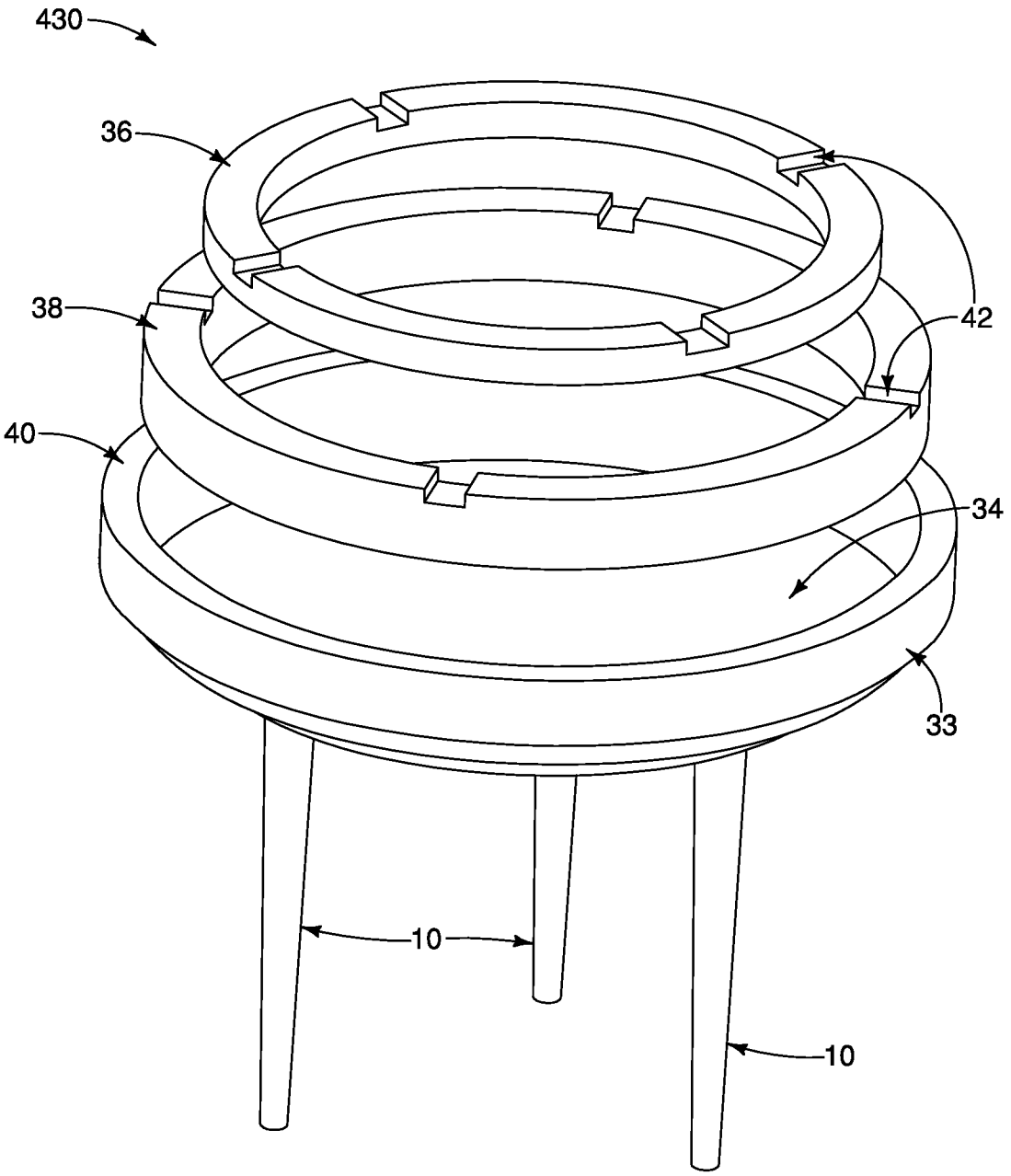
FIG. 9 is an expanded, perspective view of another exemplary embodiment of a support structure for an urn according to various embodiments of the invention.

Referring to FIG. 9, another exemplary embodiment of a circular urn saddle 430 is shown and described. Similar structures and components used in the previously described circular urn saddle 30 are used for this embodiment. First, again referring to the circular urn saddle 30 previously described in FIGS. 3A, 3B, 3C, 3D, 3E, 3F, 4, 5, 6, 7 and 8, the support base 32 is a single, integral structure, that is, a one-piece complete structure (see FIGS. 3B, 3C, 3D, 3E and 3F). However, circular urn saddle 430 is more of a modular design or configuration. That is, the first and second circular ridges 36/38 are configured as separate and discrete structures, and therefore, are capable of being selectively removed from between third circular ridge 40 (and from being over the interior bottommost surface 34). First and second circular ridges 36/38 can be thought of as circular rings 36/38. Depending on the diametric dimensions of the urn to be supported, a circular ridge can be removed, or provided, as needed to accommodate urns with differing diametric dimensions.

In one embodiment of circular urn saddle 430, height dimensions (in the vertical direction) of respective circular ridges 36/38/40 can be configured wherein cooperation between respective circular ridges 36/38/40 establish the same step configuration of circular urn saddle 30. Alternatively, height dimensions (in the vertical direction) of respective circular ridges 36/38/40 can be configured wherein cooperation between respective circular ridges 36/38/40 establish a coplanar surface between respective uppermost surfaces of the circular ridges 36/38/40.

Still referring to FIG. 9, the modular design or configuration for circular urn saddle 430 allows for the capability to selectively turn or rotate one (or both) of first and second circular ridges 36/38 on an imaginary vertical axis relative to the third circular ridge 40. The imaginary vertical axis is generally oriented extending vertically perpendicularly to the support base 32 of the circular urn saddle 30. In one embodiment, first and second circular ridges 36/38 are capable of rotation without additional structure. For example, when materials for circular urn saddle 430 are selected to minimize friction such as stainless steel. Alternatively, bearings can be provided between respective circular ridges that are configured to move or rotate. Exemplary bearings include ball bearings or linear bearings aligned in the diametric direction of the respective circular ridges. Additionally, a small electric motor (not shown) can be configured to operatively cooperate with the circular ridges to selectively rotate same. An exemplary purpose for this rotating capability is to display an entire periphery of an urn which may have different designs and/or display matter on different portions of the periphery of the urn. It should be understood that if it is desired for the first circular ridge 36 to be stationary relative to the second circular ridge 38 (that is, no relative rotation), then an extension (not shown) extending outwardly from the laterally outside periphery of first circular ridge 36 can be placed in a notch 42 of the second circular ridge 38. The same result can be achieved if an extension (not shown) extending inwardly from the laterally inside periphery of second circular ridge 38 is placed in a notch 42 of the first circular ridge 36. Both configurations of cooperation would still allow for either of the first and second circular ridges 36/38 to be removed from the circular urn saddle 430. Moreover, the same extension-notch 42 configuration can be provided for the second and third circular ridges 38/40 to terminate (cease) relative movement between the two.

An exemplary support base 32 for circular urn saddle 30 is composed of plastic and produced by a method of plastic injection molding. Exemplary plastics include thermoplastics, thermosetting plastics and similar materials which can be characterized as being ductile and/or malleable which provides the capability of being molded into various forms and then hardened, ultimately to be configured as a support base 32. Furthermore, these plastic materials can be generally characterized by any of various nonmetallic compounds, synthetically produced, usually from organic compounds by polymerization, or formed into pliable sheets or films, fibers, flexible or hard foams. Exemplary plastic materials include polystyrene, acrylonitrile butadiene styrene (ABS), polyamide, polypropylene, polyethylene, and polyvinyl chloride (PVC). Other exemplary nonmetallic compounds include spun glass or fiberglass which is a composite of extremely fine fibers of glass combined with polymers and epoxies.

Other compositions for support base 32 are contemplated such as metals or similar materials. Exemplary metals or similar material include tin, iron, aluminum, zinc, brass, gold, silver, bronze, copper, and alloys of any one metal or any combination of the metals such as steel, stainless steel, etc. The metals or similar material can be characterized as being ductile and/or malleable. Being ductile and malleable allows for the metal or similar material to be molded into various forms and then hardened, ultimately to be configured as a support base 32. Still further, exemplary support bases 32 can be composed of wood or ceramic materials.

It should be understood that any structure or component of any circular urn saddle disclosed in this document and be comprised of any one of the above stated materials.

Figure 10A:
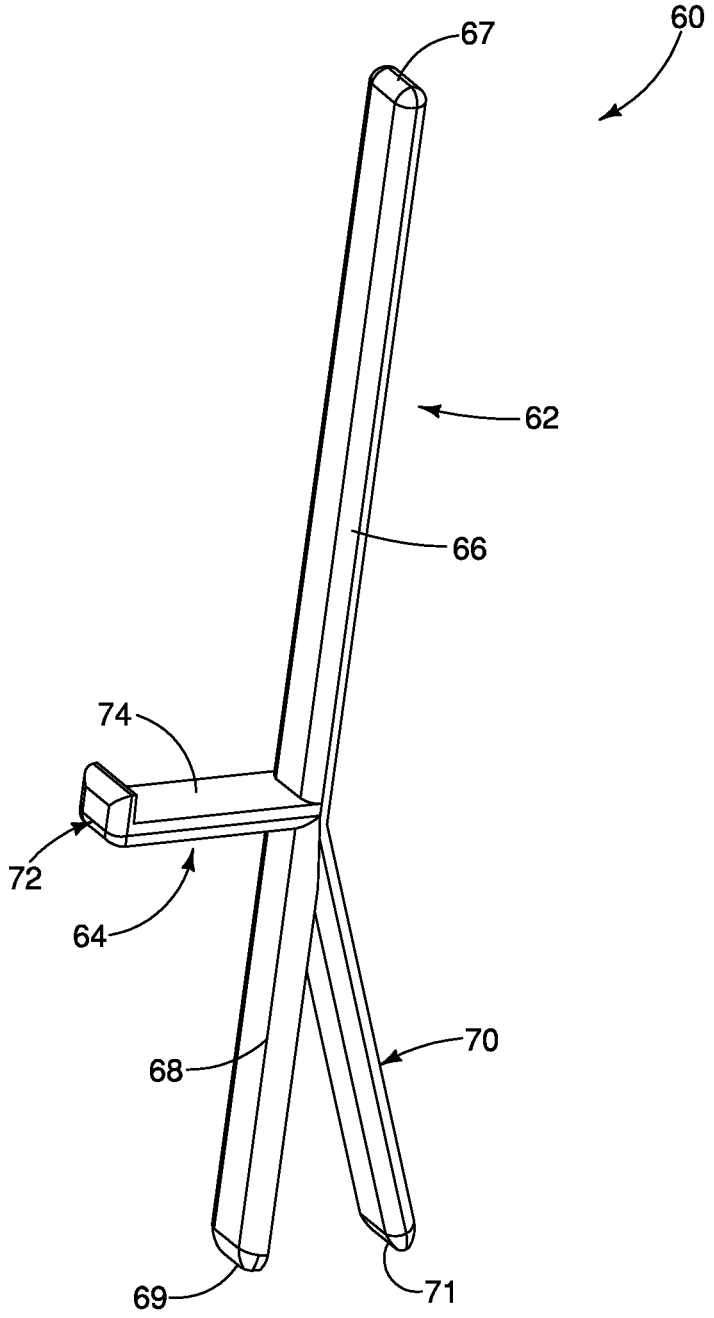
FIGS. 10A, 10B, 10C and 10D are various views of an exemplary embodiment of a support structure for funeral displays according to various embodiments of the invention.
Figure 10B:
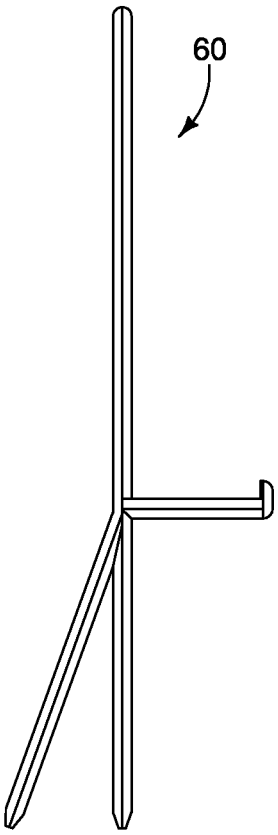
Figure 10C:
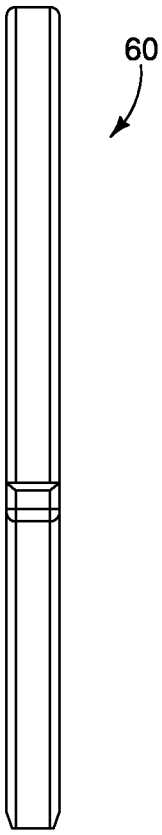
Figure 10D:
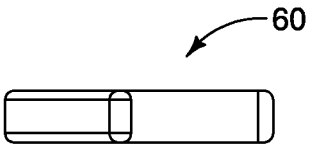

Referring to FIGS. 10A, 10B, 10C and 10C, an exemplary support structure 60 for funeral display accessories is illustrated wherein exemplary funeral display accessories are picture frames. The support structure 60 can be referred to as an easel. An exemplary easel 60 has a primary linear structure 62 with a support arm 64 extending from one side of the primary linear structure 62. The support arm 64 includes a support surface 74. The portion of the primary linear structure 62 above the support arm 64 can be referred to as a backbone 66 of the easel 60. The portion of the primary linear structure 62 below the support arm 64 can be referred to as a primary leg 68 of easel 60. Extending at an angle from the primary linear structure 62 is a secondary leg 70. The secondary leg 70 extends from a side of the primary linear structure 62 opposite the side of the primary linear structure from which the support arm 64 extends. Moreover, the secondary leg 70 extends from generally the same elevational location of the primary linear structure 62 from which the support arm 64 extends. A lip 72 or stop extends upwardly from a terminal end of the support arm 64.

Opposite ends 67/69 of the primary linear structure 62 of easel 60 are beveled or rounded. The one terminal end of lip 72 and the one terminal end 71 of secondary leg 70 are beveled or rounded. The terminal end 71 of secondary leg 70 and the bottom end 69 of primary linear structure 62 may be rounded more closely to obtain a pointed structure or configuration to facilitate being forced into another structure such as foam.

Exemplary dimensions for primary linear structure 62 are length 8.0 inches, width 0.5 inch and thickness 0.2 inch. Other dimensions for primary linear structure 62 are contemplated. Exemplary dimensions for support arm 64 are length 1.25 inches (from primary linear structure 62 to lip 72), width 0.5 inch and thickness 0.19 inch. A bottom surface of support arm 64 is located at 3.0 inches from the bottom end 69 of primary linear structure 62 and extends generally at 90 degrees from the primary linear structure 62. Other dimensions and angles (relative to primary linear structure 62) for support arm 64 are contemplated. Exemplary dimensions for lip 72 are length 0.38 inch, width 0.5 inch and thickness 0.13 inch. Lip 72 extends generally at 90 degrees from the support arm 64. Other dimensions and angles (relative to support arm 64) for lip 72 are contemplated. Exemplary dimensions for secondary leg 70 are width 0.5 inch and thickness 0.13 inch. Secondary leg 70 extends generally at 30 degrees from the primary linear structure 62. A back-side surface of the secondary leg 70 (opposite the primary linear structure 62) intersects the primary linear structure 62 at about 3.0 inches above the bottom end 69 of the primary linear structure 62. Other dimensions, intersections and angles (relative to the primary linear structure 62) for secondary leg 70 are contemplated.

It should be understood that in one embodiment of an exemplary easel 60 comprises an one-piece structure wherein all components are integrally (permanently connected) secured together.

Figure 11:
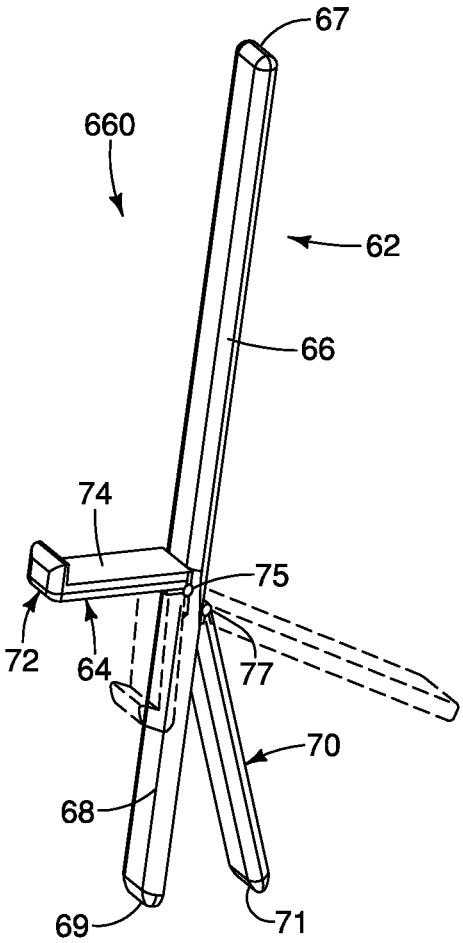
FIG. 11 is another exemplary embodiment of a support structure for funeral displays according to various embodiments of the invention.

Referring to FIG. 11, another exemplary support structure 660 for funeral display accessories is illustrated and provides the capability of components being able to pivot or rotate relative to other components. The intersection between the support arm 64 and the primary linear structure 62 includes a pivot and lock mechanism 75 (such as a hinge with teeth as is understood in the art) wherein the support arm 64 can be pivoted (rotated) relative to the primary linear structure 62 of the easel 60. The support arm 64 can be locked into a selected position at a selected angle relative to the primary linear structure 62. From the 90-degree position (that is, extending at 90 degrees relative to the primary linear structure 62), the support arm 64 can be rotated (pivoted) downwardly toward the primary leg 68 and locked in selected positions at angle increments of one, five, or ten degrees, etc. (as non-limiting examples only) from the 90-degree position. For example, if the support arm 64 is pivoted or rotated toward the primary leg 68 and locked at five degrees from the 90-degree position, the support arm 64 will be 85 degrees from the primary leg 68. The support arm 64 can be rotated until the bottom surface rests against the primary leg 68 and is locked into place for a more compact configuration for ease of transport.

Still further, and again from the 90-degree position, the support arm 64 can be rotated upwardly toward the backbone 66 of the easel 60 and locked in selected positions at angle increments of one, five, or ten degrees (as non-limiting examples only) from the 90-degree position. For example, if the support arm 64 is pivoted or rotated toward the backbone 66 and locked at twenty-five (25) degrees from the 90-degree position, the support arm 64 will be 65 degrees from the backbone 66. The support arm 64 can be rotated until the lip 72 contacts the backbone 66 and is locked into place for a more compact configuration for ease of transport. In this configuration, the support arm 64 is capable of a total angular movement of approximately 180 degrees.

Still referring to FIG. 11, the intersection between the secondary leg 70 and the primary linear structure 62 can include a pivot and lock mechanism (such as a hinge with teeth as is understood in the art) wherein the secondary leg 70 can be pivoted (rotated) relative to the primary linear structure 62 of the easel 60. The secondary leg 70 can be locked into a selected position at a selected angle relative to the primary linear structure 62. That is, the secondary leg 70 can be rotated (pivoted) downwardly toward the primary leg 68 and locked in selected positions at angle increments of one, five, or ten degrees, etc. (as non-limiting examples only) from the 30-degree position (that is, extending at 30 degrees relative to the primary leg 68). For example, if the secondary leg 70 is pivoted or rotated toward the primary leg 68 and locked at five degrees from the 30-degree position, the secondary leg 70 will be 25 degrees from the primary leg 68. The secondary leg 70 can be rotated until it rests against the primary leg 68 and is locked into place for a more compact configuration for ease of transport.

Still further, the secondary leg 70 can be rotated upwardly toward the backbone 66 of the easel 60 and locked in selected positions at angle increments of one, five, or ten degrees (as non-limiting examples only) from the 30-degree position. For example, if the secondary leg 70 is pivoted or rotated toward the backbone 66 and locked at twenty-five (25) degrees from the 30-degree position, the secondary leg 70 will be 55 degrees from the primary leg (and 125 degrees from the backbone 66). The secondary leg 70 can be rotated until the lip 72 contacts the backbone 66 and is locked into place for a more compact configuration for ease of transport. It should be understood that a single easel 60 can have pivoting capabilities for both of the secondary leg 70 and the support arm 64. In this configuration, the secondary leg 70 is capable of a total angular movement of approximately 180 degrees.

An exemplary support structure/easel is composed of plastic and produced by a method of plastic injection molding. Exemplary plastics include thermoplastics, thermosetting plastics and similar materials which can be characterized as being ductile and/or malleable which provides the capability of being molded into various forms and then hardened, ultimately to be configured as a support structure/easel. Furthermore, these plastic materials can be generally characterized by any of various nonmetallic compounds, synthetically produced, usually from organic compounds by polymerization, or formed into pliable sheets or films, fibers, flexible or hard foams. Exemplary plastic materials include polystyrene, acrylonitrile butadiene styrene (ABS), polyamide, polypropylene, polyethylene, and polyvinyl chloride (PVC). Other exemplary nonmetallic compounds include spun glass or fiberglass which is a composite of extremely fine fibers of glass combined with polymers and epoxies.

Other compositions for support structure/easel are contemplated such as metals or similar materials. Exemplary metals or similar material include tin, iron, aluminum, zinc, brass, gold, silver, bronze, copper, and alloys of any one metal or any combination of the metals such as steel, stainless steel, etc. The metals or similar material can be characterized as being ductile and/or malleable. Being ductile and malleable allows for the metal or similar material to be molded into various forms and then hardened, ultimately to be configured as a support structure/easel. Still further, exemplary support structure/easel can be composed of wood or ceramic materials.

It should be understood that any structure or component of any support structure configured as an easel and disclosed in this document can be comprised of any one of the above stated materials.

Figure 12:
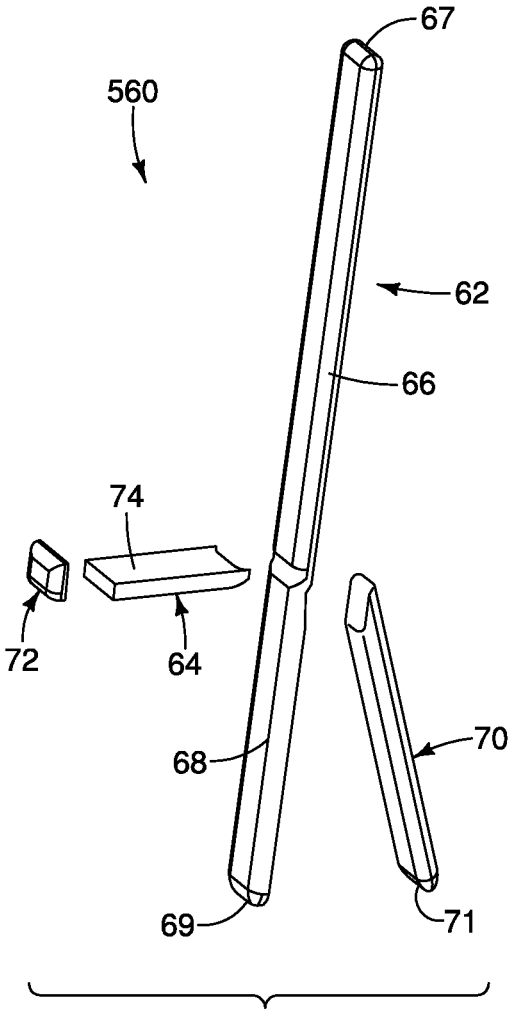
FIG. 12 is another exemplary embodiment of a support structure for funeral displays according to various embodiments of the invention.

Referring to FIG. 12, another exemplary support structure 560 for funeral display accessories is illustrated as a modular design or configuration. With this configuration, one or more components of support structure 560 can be selectively detached (removed) or selectively attached to other components of support structure 560. In this embodiment shown, all the components (primary linear structure 62, support arm 64, backbone 66, primary leg 68, secondary leg 70 and lip 72) are capable of being selectively detached (removed) or selectively attached to other components of support structure 560. It should be understood that any combination of the components of support structure 560 can be integral as one-piece structures (permanently secured together) with any combination of the other components being selectively detachable or selectively attachable. Various connecting methods can be relied upon to attach and detach the components, for example, snapping the components together as is understood by one skilled in the art.

As an example of some components of support structure 560 being integral while other components are detachable/attachable, consider the primary linear structure 62 and the secondary leg 70 as being formed together as a single, integral structure. However, the primary linear structure 62/secondary leg 70 combination is formed without the support arm 64. The support arm 64 (with or without the lip 72) is removably detachable/attachable to the primary linear structure 62/secondary leg 70 combination. Another example, the primary linear structure 62 and the support arm 64 (with or without the lip 72) are formed together as a single, integral structure, but the primary linear structure 62/support arm 64 combination is formed without the secondary leg 70. The secondary leg 70 is removably detachable/attachable to the primary linear structure 62/support arm 64 combination. Still another example, the primary linear structure 62 is formed as a single, integral structure without the secondary leg 70 and without the support arm 64. The support arm 64 (with or without the lip 72) and the secondary leg 70 are removably detachable/attachable to the primary linear structure 62.

Figure 13:
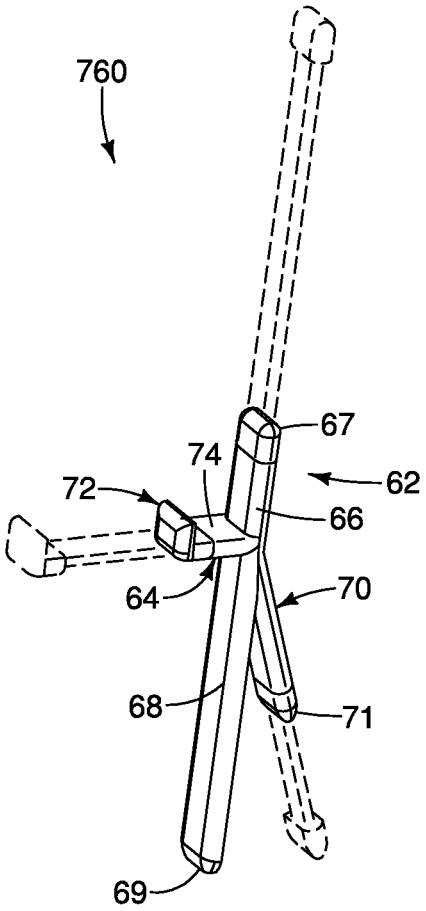
FIG. 13 is another exemplary embodiment of a support structure for funeral displays according to various embodiments of the invention.

Referring to FIG. 13, another exemplary support structure 760 for funeral display accessories is illustrated as having a telescoping design or configuration. In this exemplary embodiment, one or more of the primary linear structure 62, support arm 64 and the secondary leg 70 are configured as telescoping structures to increase, or decrease, their respective length dimensions. For example, the support arm 64 can be made up of two separate linear structures, both having the same cross-sectional configurations except one having smaller cross-sectional dimensions to be able to slide into (or over, depending on which is larger and which is smaller) the other of the two separate structures. One linear structure of the support arm 64 can have a row of knob or nodules (not shown) that under slight pressure downward on top of each nodule can move the nodule downwardly, and correspondingly, a release of the pressure allows the nodule to spring back upward to its original position. The other linear structure can have a row of openings (not shown). When the two linear structures of the support arm 64 are together, the row of notches is aligned with the row of openings. As one linear structure of the support arm 64 slides relative to the other linear structure, the nodules pivot in and out of the openings until a length of the support arm 64 is selected and the nodules are allowed to rest in aligned openings to maintain the selective length of the support arm 64.

Exemplary support structure 760 further includes the primary linear structure 62 having a telescoping configuration and the secondary leg 70 having a telescoping configuration. Any combination of the components of support structure 760 can have the telescoping capability while any other combination of the components of support structure 760 can lack the telescoping capability.

Figure 14:
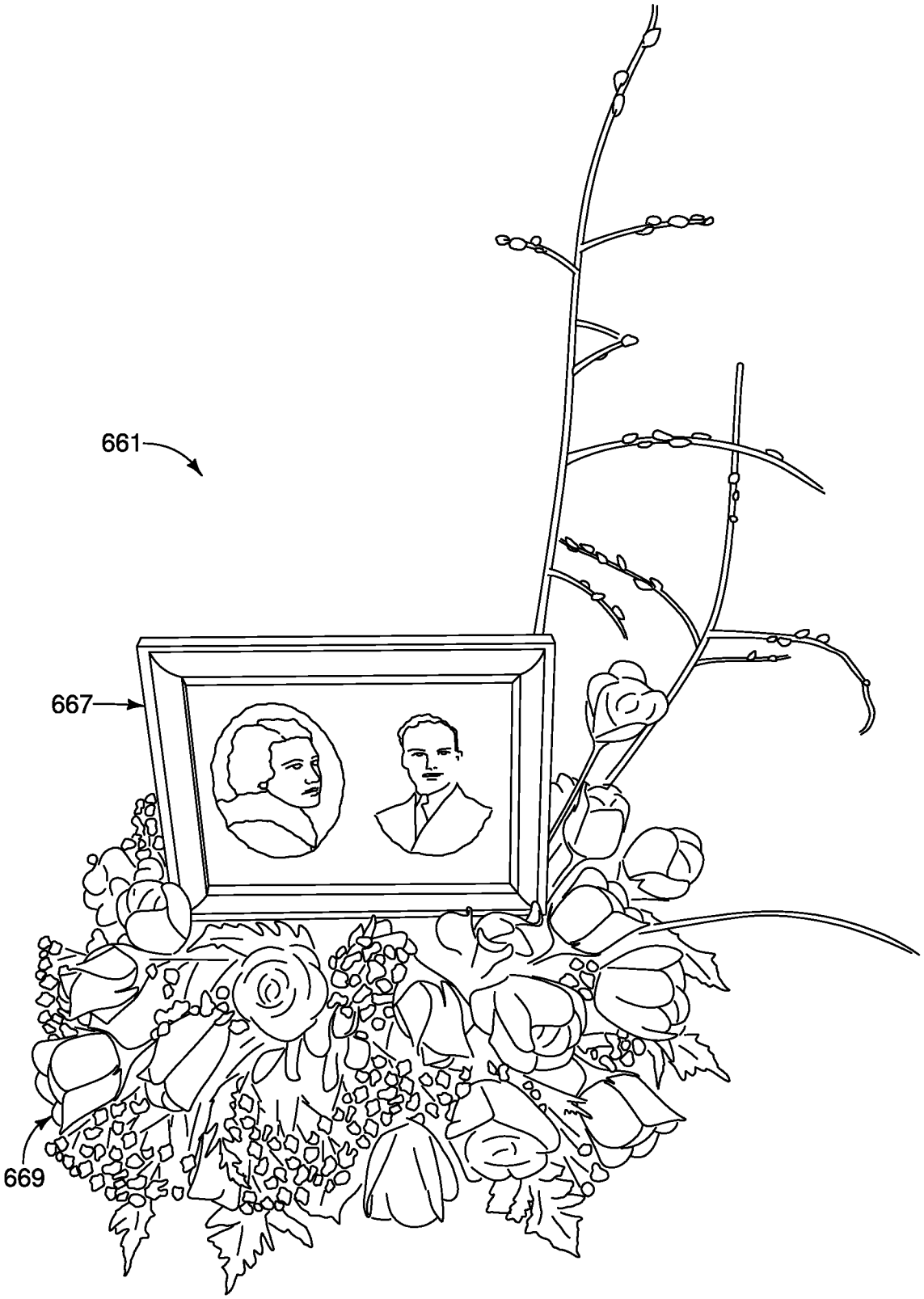
FIG. 14 is a perspective view of a funeral display that uses various embodiments of the invention.

Referring to FIG. 14, an exemplary method 661 of using an exemplary support structure/easel (although the support structure/easel cannot be seen) in a funeral display is shown. Two or more support structures/easels are provided (not seen) and spaced apart from each other. A picture included in a picture frame 667 is provided and supported upon the support surface of the support arm of the support structure/easel. A floral arrangement 669 is provided to surround a portion of the picture frame 667. The support structures/easels can be supported upon any surface. As an example, the bottom ends of support structures/easels are supported upon (or forced into) foam structures such as wet or silk/dry floral foam used in floral and funeral displays. Additionally, the floral foam(s) can be provided in various bases or receptacles (described subsequently) for additional support.

Figure 15:
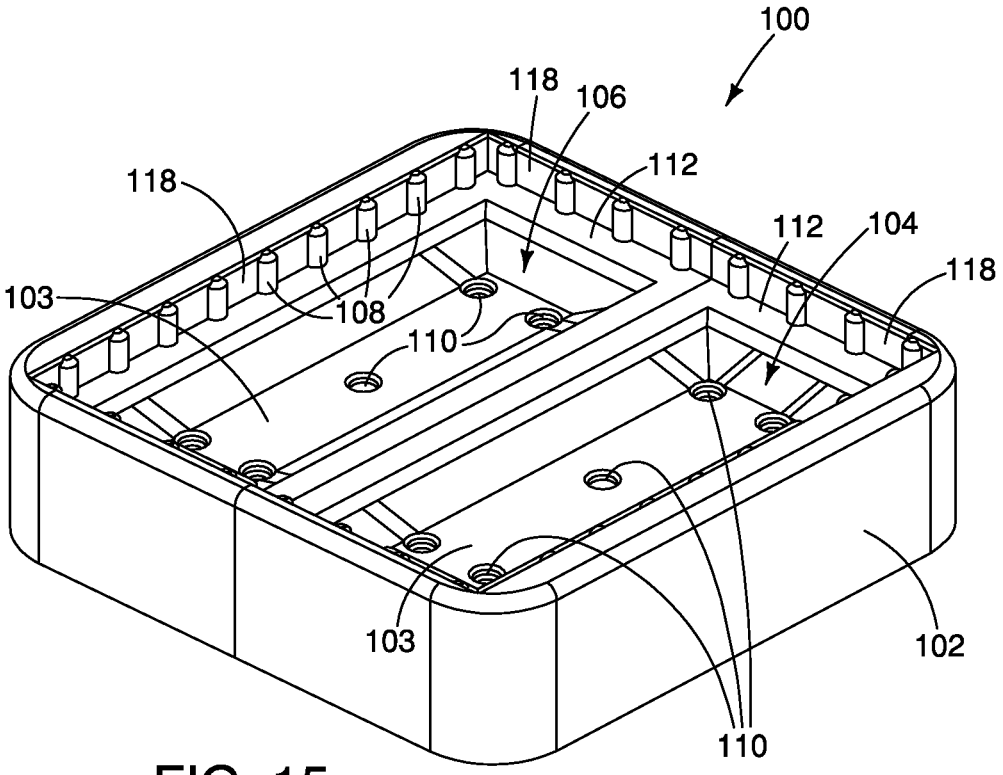
FIG. 15 is a perspective view of an exemplary embodiment of a base for a support structure of an urn according to various embodiments of the invention.
Figure 16:
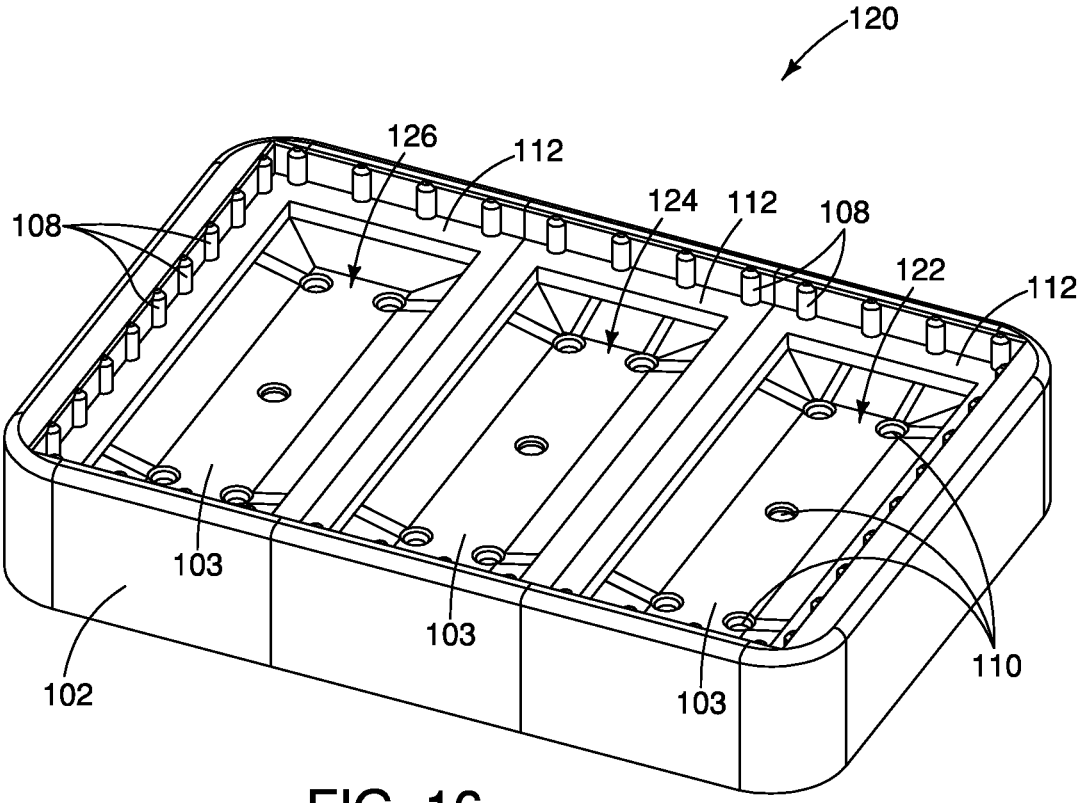
FIG. 16 is a perspective view of an exemplary embodiment of a base for a support structure of an urn according to various embodiments of the invention.

Referring to FIGS. 15, 16, 17A, 17B, 17C, 17D, 18A, 18B, 19A, 19B, 19C, 20, 21A, 21B, 21C, 21D, 21E and 21F, various bases (or receptacles) are illustrated according to embodiments of the inventions and are ultimately used as support structures for urns and funeral display accessories. Referring to FIGS. 15 and 16, bases 100 and 120, respectively, have the same design except base 120 is larger than base 100 due to having more recesses. Accordingly, some of the reference numbers will be the same for both embodiments. For example, in one exemplary embodiment, each base 100/120 has a square or rectangular exterior wall 102. Additionally, base 100 of FIG. 15 has two recesses 104 and 106 while base 120 of FIG. 16 has three recesses 122, 124 and 126. Each recess has a planar, rectangular and interior bottommost (lowermost) surface 103 which define drain (or drainage) openings 110 that extend entirely through the interior bottommost surface 103. Slanted walls extend upwardly and laterally outwardly from each side of the interior bottommost surface 103. The slanted walls terminate at planar support surfaces 112 which are generally parallel with the interior bottommost surface 103.

Accordingly, base 100 has a support surface 112 above and surrounding recess 104 and a support surface 112 above and surrounding recess 106. Base 120 has a support surface 112 above and surrounding recess 122, a support surface 112 above and surrounding recess 124 and a support surface 112 above and surrounding recess 126. Each base 100/120 has an inner periphery wall 118 opposite from exterior wall 102 and which extends upwardly from the support surfaces 112. Each base 100/120 has ridges or ribs 108 extending inwardly from the respective inner periphery walls 118. Each ridge 108 is equidistant from the next ridge 108 along the respective inner periphery wall 118. Each ridge 108 is configured as a half-circle in a horizontal cross section. Other horizontal cross section configurations are contemplated for ridges 108. Respective ridges 108 extend upwardly from respective support surfaces 112.

Referring to FIGS. 17A, 17B, 17C and 17D, another exemplary base (or receptacles) 240 is illustrated. Similar structures may have common reference numbers. Base 240 has three rectangular recesses 242/244/246. Base 240 has a square or rectangular exterior wall 255. Accordingly, each recess has a width dimension 270 and a length dimension 272 (see FIG. 17B). Still referring to FIG. 17B, each recess 242/244/246 has four surfaces that slope downwardly: two sloping surfaces 257 are triangularly shaped and have edges extending along the width dimension 270 of each recess; and two sloping surfaces 259 are shaped as isosceles trapezoids and have edges extending along the length dimension 272 of each recess. Other shapes for the four downward sloping surfaces 257/259 are contemplated. The sloping surfaces 257/259 of each recess 242/244/246 slope downwardly to terminate in a pair of drain (or drainage) openings 250 and define generally the interior bottommost portion of each recess 242/244/246. Each drain openings 250 have a linear and rectangular configuration that extends parallel to the length dimension 272 of each recess. Instead of two drain openings 250 for each recess, other numbers of drain openings 250 are contemplated such as one, three, four, etc. Moreover, other geometric configurations for the drain openings 250 are contemplated such as circles, ovals, square, etc.

Figure 17A:
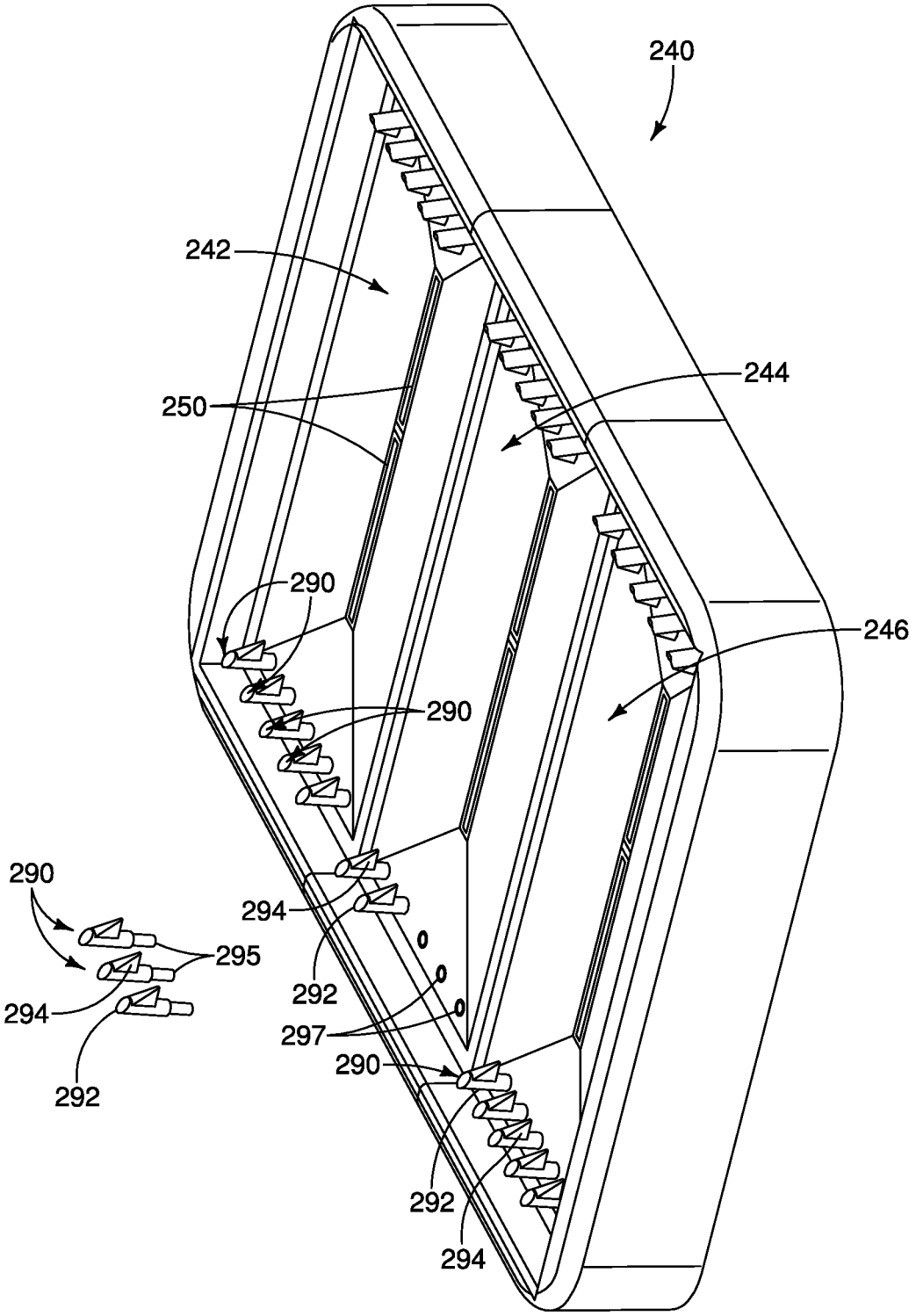
FIGS. 17A, 17B, 17C and 17D are various views of an exemplary embodiment of a base for a support structure of an urn according to various embodiments of the invention.
Figure 17B:
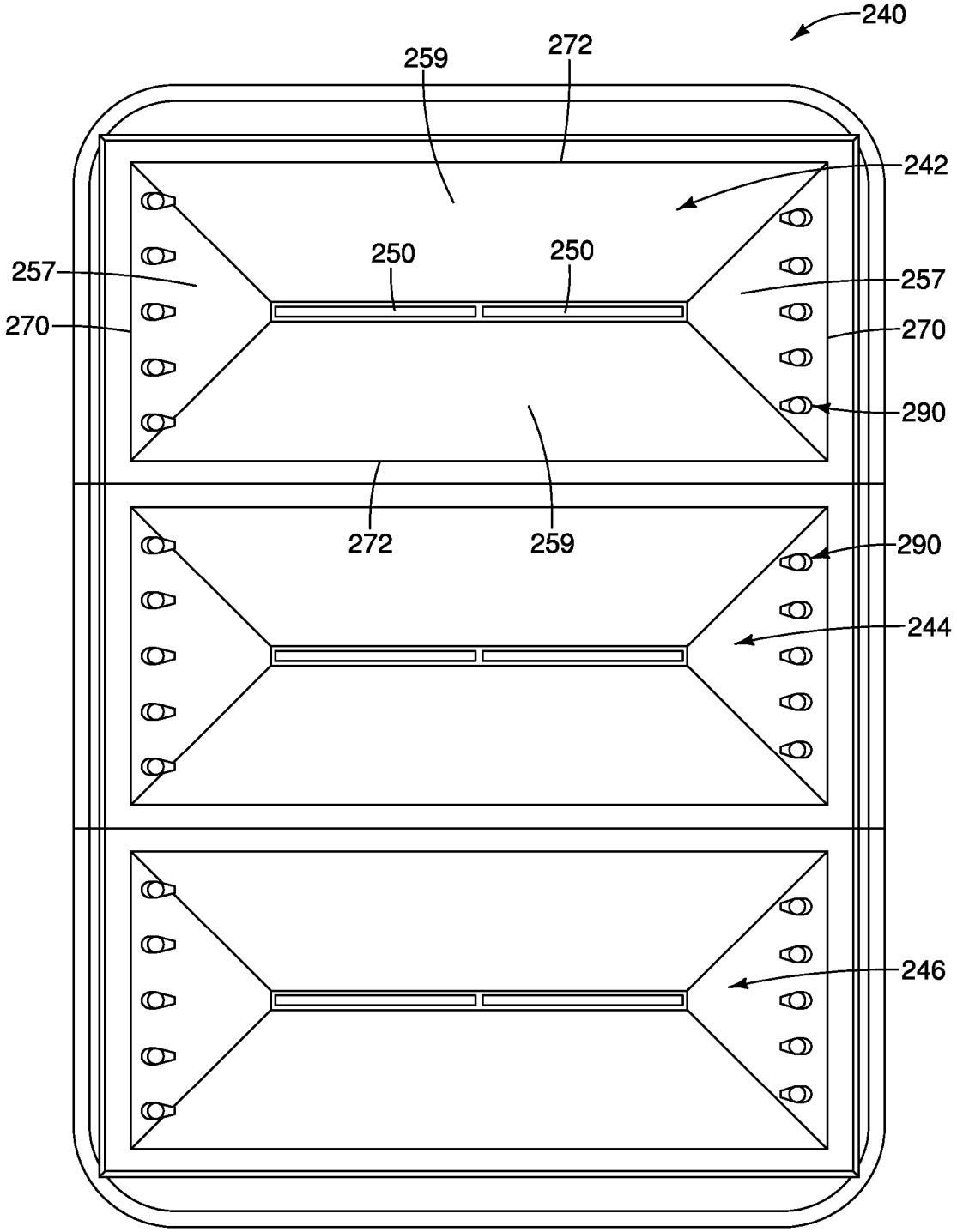

Still referring to FIGS. 17A, 17B, 17C and 17D, each recess 242/244/246 has retaining or securement structures termed herein as spikes (hooks) 290. In this embodiment, each spike 290 extends upwardly from each triangularly shaped sloping surface 257 of each recess. Each exemplary spike 290 has a cylindrical pole portion 292 and a hook portion 294. The cylindrical pole portion 292 is secured in the sloping surfaces 257. The hook portion 294 extends outward from the cylindrical pole portion 292 and is spaced from the sloping surfaces 257. The hook portion 294 terminates in a point that extends downwardly toward (or directed to) each recess 242/244/246. Referring to FIG. 17A, openings 297 in one or more of the four downward sloping surfaces 257/259 receive a segment of the cylindrical pole portion 292 of spikes 290. In this embodiment, openings 297 are in the triangularly shaped sloping surfaces 257 (see FIG. 17B). Still referring to FIG. 17A and in this embodiment, spikes 290 rest in openings 297 allowing for the capability of the spikes 290 to be selectively removed from openings 297 or selectively provided in openings 297. Alternatively, the spikes 290 can be permanently secured to any one of the four downwardly sloping surfaces 257/259. Exemplary methods for permanent securement is as an integral structure of the sloping surfaces or by cement/glue provided in the openings.

Figure 17D:
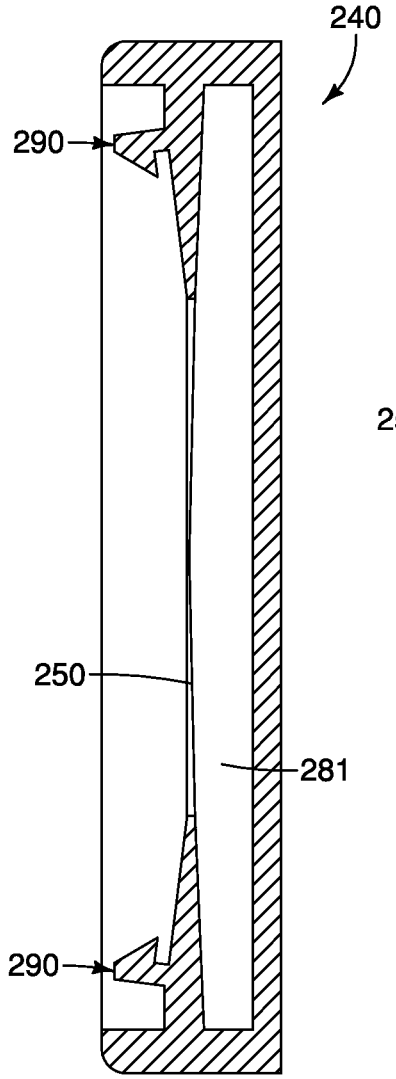
Figure 17C:
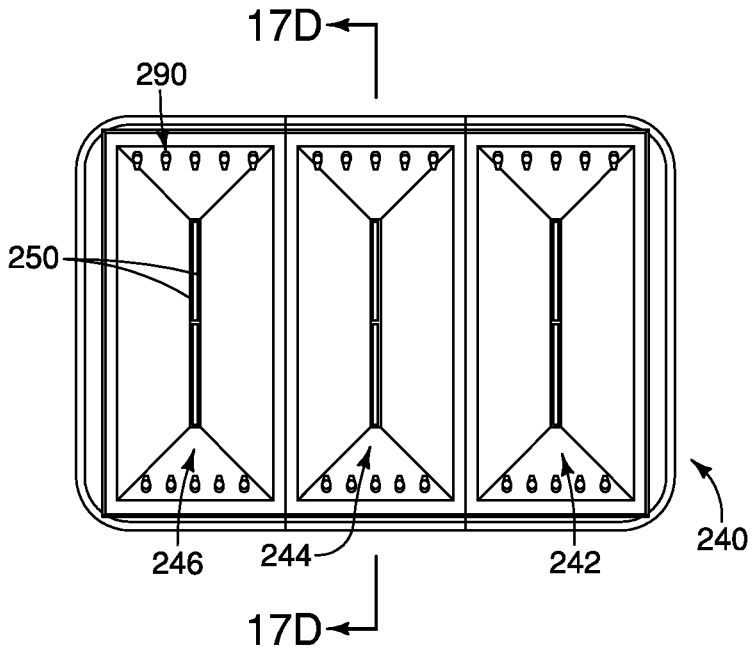

Still referring to FIGS. 17A, 17B, 17C and 17D, base (or receptacles) 240 includes five spikes 290 aligned in a row along the width dimension 270 of each recess 242/244/246 and no spikes along the length dimension 272 of the recesses. Referring to FIG. 17D, drain openings 250 provide fluid communication between cavities 281 and each recess 242/244/246.

Figure 18A:
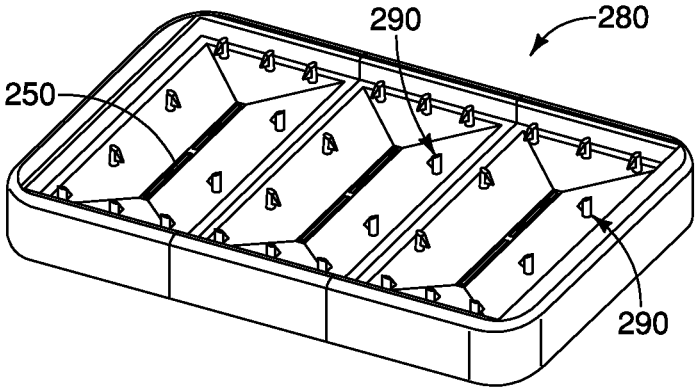
FIGS. 18A and 18B are various views of an exemplary embodiment of a base for a support structure of an urn according to various embodiments of the invention.
Figure 18B:
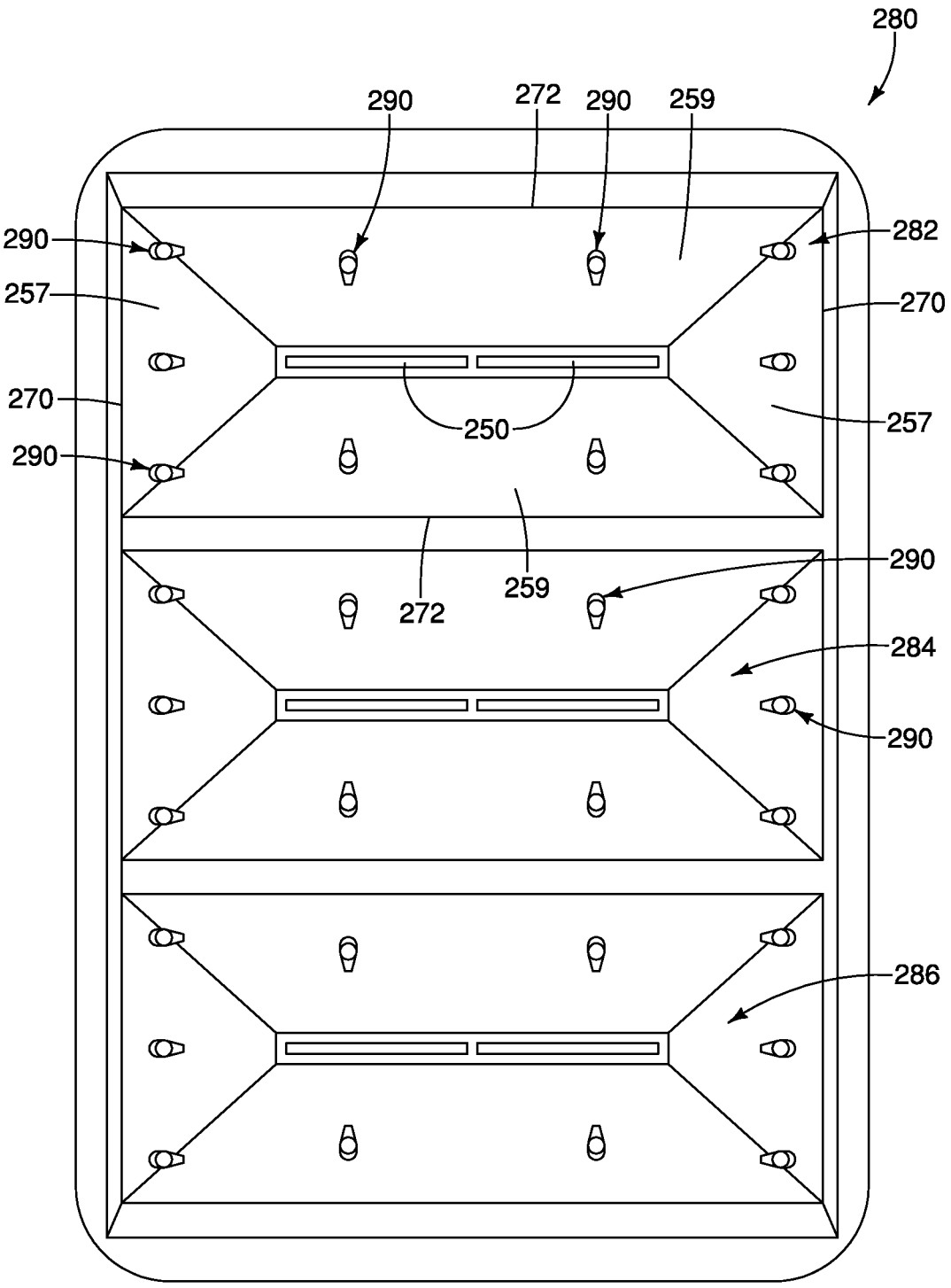

Referring to FIGS. 18A and 18B, another exemplary base (or receptacles) 280 is illustrated. Similar structures are referenced with the same numbers as used in the previously described bases. Base 280 has three spikes 290 aligned in a row along the width dimension 270 of each recess 282/284/286. Moreover, base 280 has two spikes 290 aligned in a row along the length dimension 272 of each recess 282/284/286.

Figure 19A:
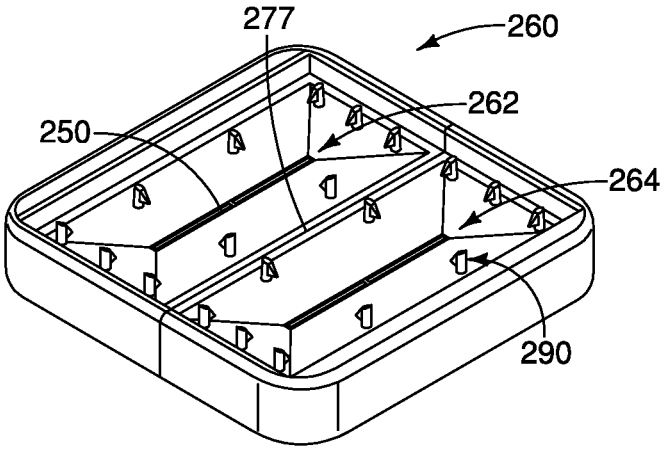
FIGS. 19A, 19B and 19C are various views of an exemplary embodiment of a base for a support structure of an urn according to various embodiments of the invention.
Figure 19C:
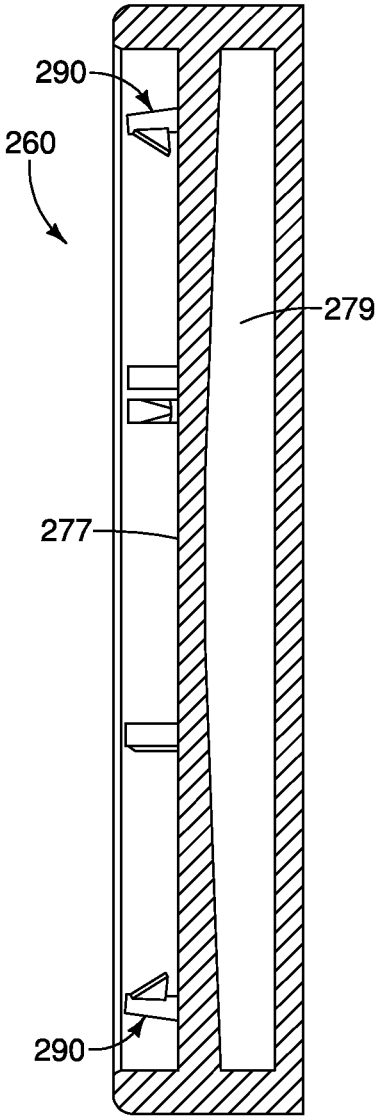
Figure 19B:
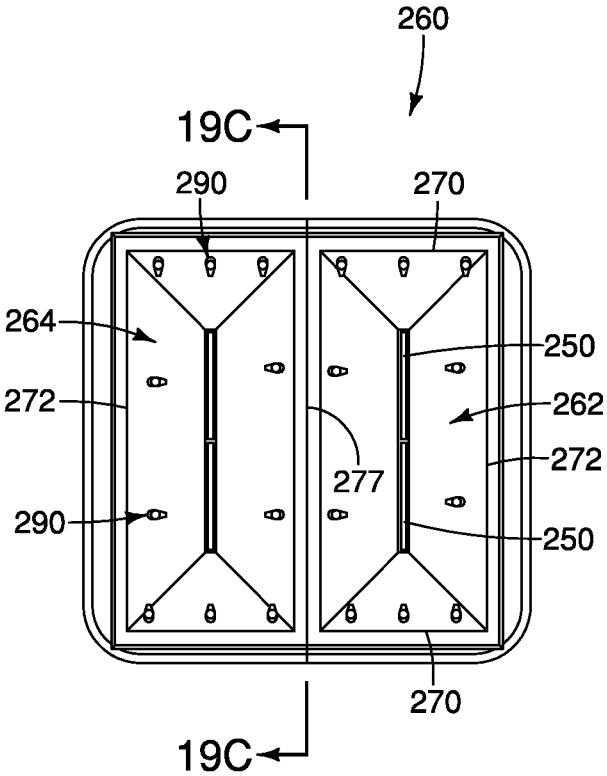

Referring to FIGS. 19A-C, another exemplary base (or receptacles) 260 is illustrated. Similar structures are referenced with the same numbers as used in the previously described bases. Base 260 has only two recesses 262/264 divided by a centrally located upper surface 277. An exemplary base 260 has three spikes 290 aligned in a row along the width dimension 270 of each recess 262/264. Still further, base 260 has two spikes 290 aligned in a row along the length dimension 272 of each recess 262/264. Referring to FIG. 19C, cavity 279 is shown below upper surface 277.

Referring to FIGS. 19A, 19B and 19C, another exemplary base (or receptacles) 260 is illustrated. Similar structures are referenced with the same numbers as used in the previously described bases. Base 260 has only two recesses 262/264 divided by a centrally located upper surface 277. An exemplary base 260 has three spikes 290 aligned in a row along the width dimension 270 of each recess 262/264. Still further, base 260 has two spikes 290 aligned in a row along the length dimension 272 of each recess 262/264. Referring to FIG. 19C, cavity 279 is shown below upper surface 277.

Figure 20:
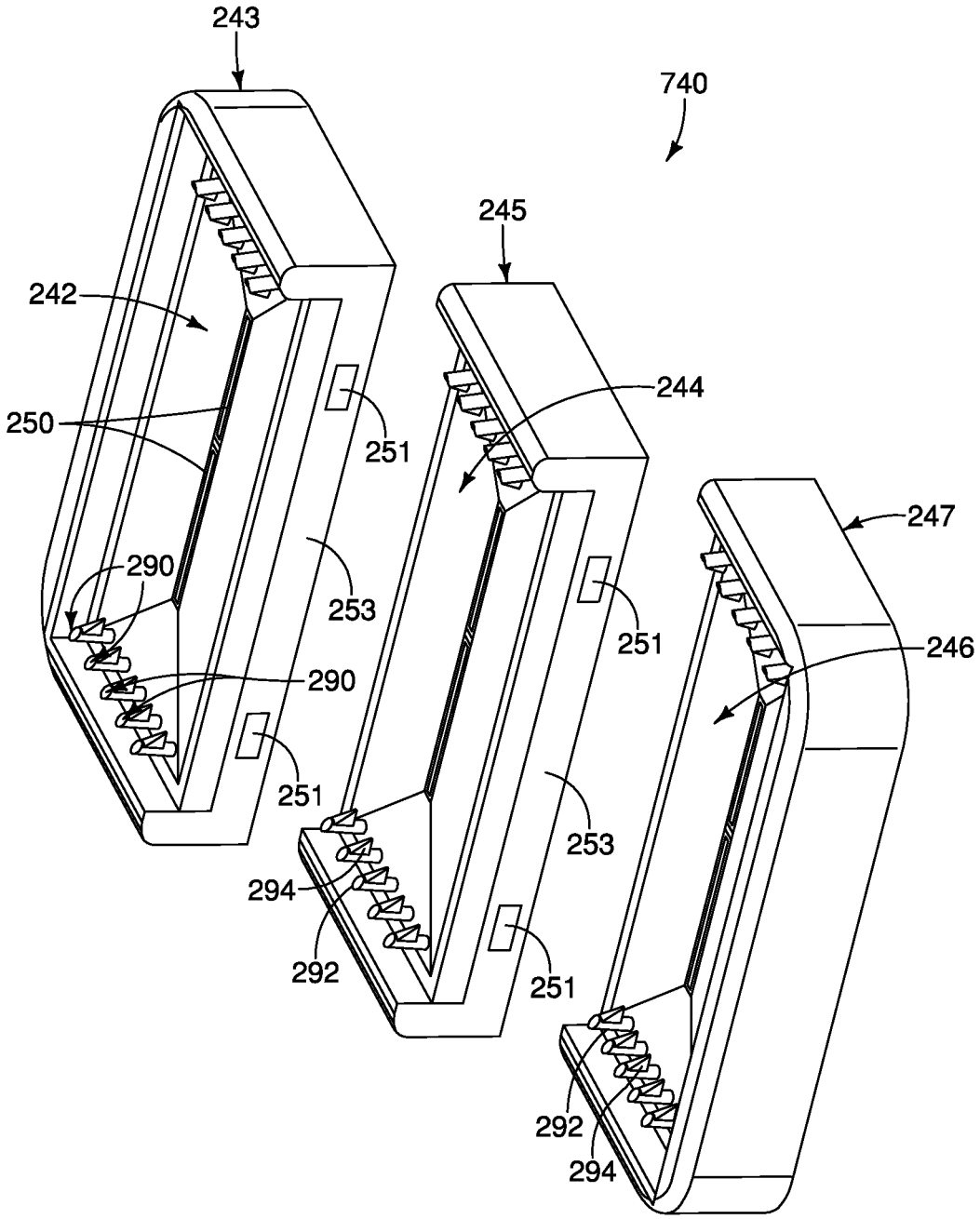
FIG. 20 is an exemplary embodiment of a base for a support structure of an urn according to various embodiments of the invention.

Referring to FIG. 20, another exemplary base (or receptacles) 740 is illustrated. Similar structures are referenced with the same numbers as used in the previously described bases. Base 740 has a modular configuration comprised of three modular structures 243, 245 and 247 each defining a recess, 242, 244 and 246, respectively. Each modular structure 243, 245 and 247 can be selectively detached, and selectively attached, to an adjacent modular structure 243, 245 and 247. Each modular structure 243, 245 and 247 has at least one outer periphery surface 253 with at least one connection device 251 represented simply as rectangle for simplicity. An exemplary connection device 251 can be a magnet. Another exemplary connection device 251 can be a fastening tape such as Velcro®. Still another exemplary connection device 251 can be a hairpin clip combination. Yet another exemplary connection device 251 can be a dovetail joint combination.

In one of various aspects of the inventions, it should be understood that the bases described herein can be used in floral cremation designs. The recesses of each base are configured to receive standard floral foam blocks for supporting flower arrangements, urn saddles, and picture frame accessories. As stated previously, each base has a hole to drain excess water from the foam block. The walls of the receptacle have ridges extending towards the middle to help keep the foam securely wedged therein. The bases can be used with other inventive components described throughout this document and such is shown subsequently.

An exemplary base of any of the embodiments disclosed in this document can be composed of plastic and produced by a method of plastic injection molding. Exemplary plastics include thermoplastics, thermosetting plastics and similar materials which can be characterized as being ductile and/or malleable which provides the capability of being molded into various forms and then hardened, ultimately to be configured as a base. Furthermore, these plastic materials can be generally characterized by any of various nonmetallic compounds, synthetically produced, usually from organic compounds by polymerization, or formed into pliable sheets or films, fibers, flexible or hard foams. Exemplary plastic materials include polystyrene, acrylonitrile butadiene styrene (ABS), polyamide, polypropylene, polyethylene, and polyvinyl chloride (PVC). Other exemplary nonmetallic compounds include spun glass or fiberglass which is a composite of extremely fine fibers of glass combined with polymers and epoxies.

Other compositions for any one of the embodiments of bases described in this document are contemplated such as metals or similar materials. Exemplary metals or similar material include tin, iron, aluminum, zinc, brass, gold, silver, bronze, copper, and alloys of any one metal or any combination of the metals such as steel, stainless steel, etc. The metals or similar material can be characterized as being ductile and/or malleable. Being ductile and malleable allows for the metal or similar material to be molded into various forms and then hardened, ultimately to be configured as a base. Still further, an exemplary base can be composed of wood or ceramic materials.

Referring to FIGS. 21A, 21B, 21C, 21D, 21E, 21F, 22 and 23, another exemplary support structure for urns is illustrated. This support structure can be referenced as an urn saddle for square or rectangular urns while the previously discussed urn saddle was configured for circular urns. For distinction, this support structure will be referenced as a rectangular urn saddle.

Figure 21A:
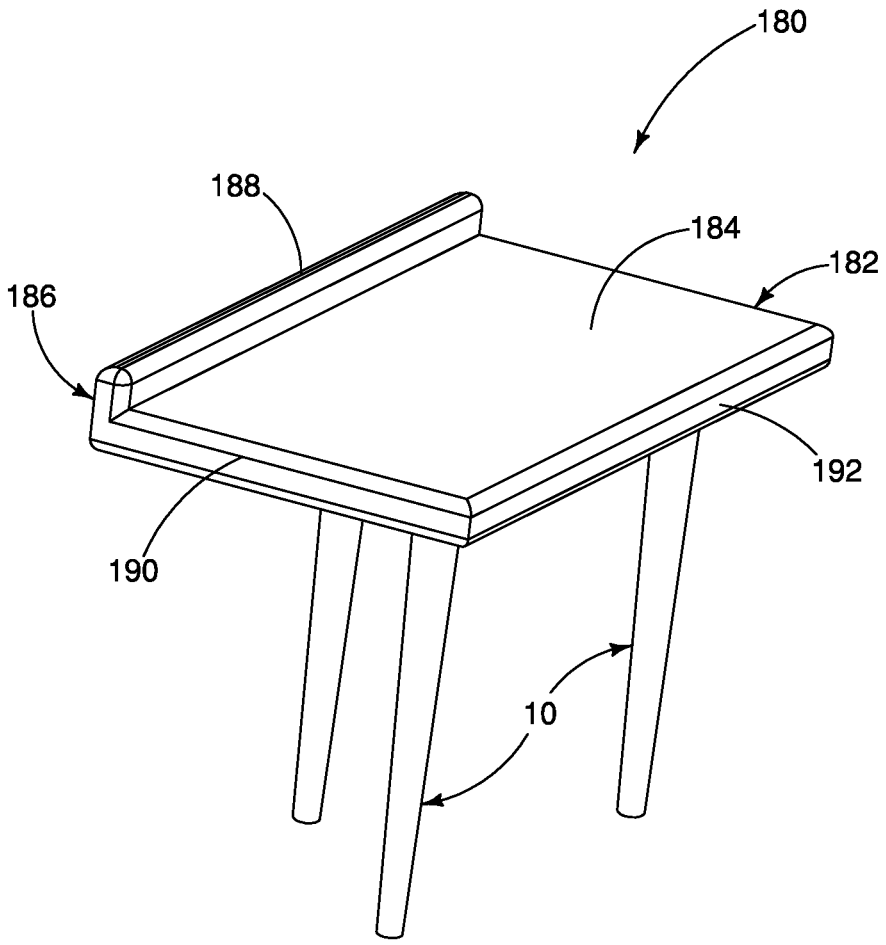
FIGS. 21A, 21B, 21C, 21D, 21E and 21F are various views of an exemplary embodiment of a support structure for an urn according to various embodiments of the invention.
Figure 21B:
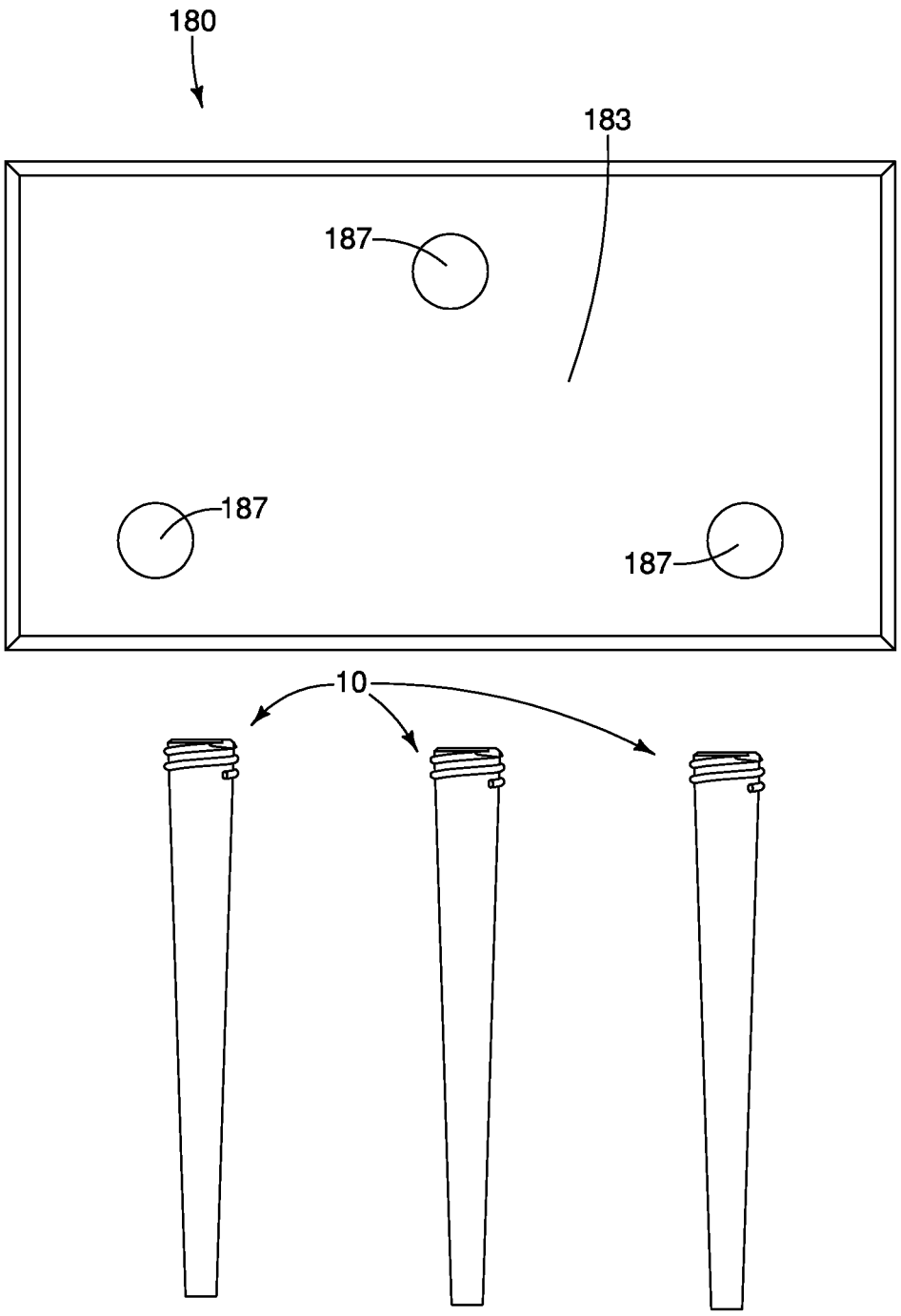
Figure 21C:
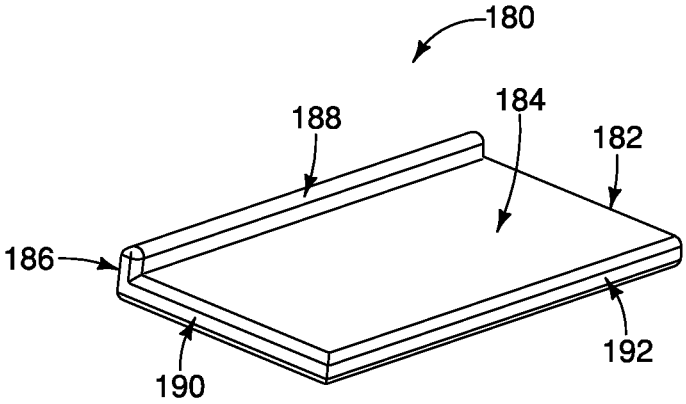
Figure 21D:
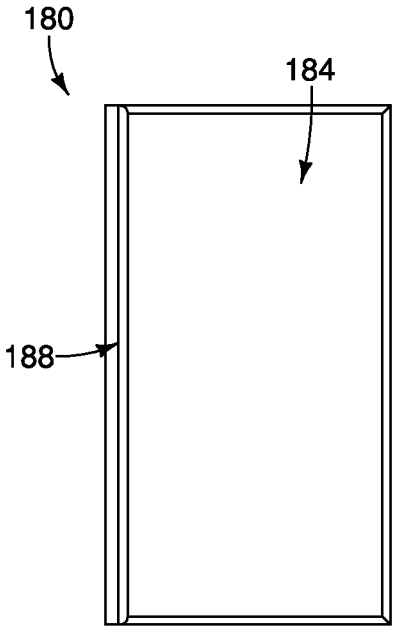
Figure 21E:
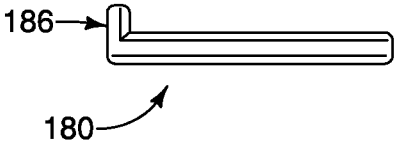
Figure 21F:
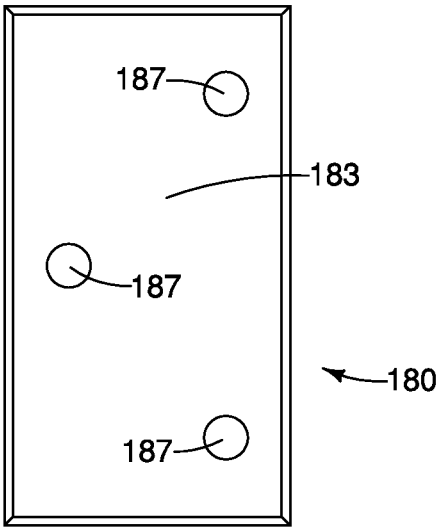

Referring to FIGS. 21A, 21B, 21C, 21D, 21E and 21F, a rectangular urn saddle 180 includes a rectangular or square base (support surface) 182 having a bottom surface 183 (see FIG. 21B) removably secured to legs 10 which were discussed previously. Opposite to the bottom surface, the square base 182 has a planar, upper support surface 184 for receiving structures. Upper support surface 184 has a front edge 192 that is rounded or beveled and two side edges 190 that are rounded or beveled. A back edge of the support surface 184 is formed as an upwardly extending stop 186 that has an upper edge 188 that is rounded or beveled. Referring to FIGS. 21B and 21F, the bottom surface 183 of the rectangular urn saddle 180 is illustrated with three openings 187 to receive three legs 10.

Figure 22:
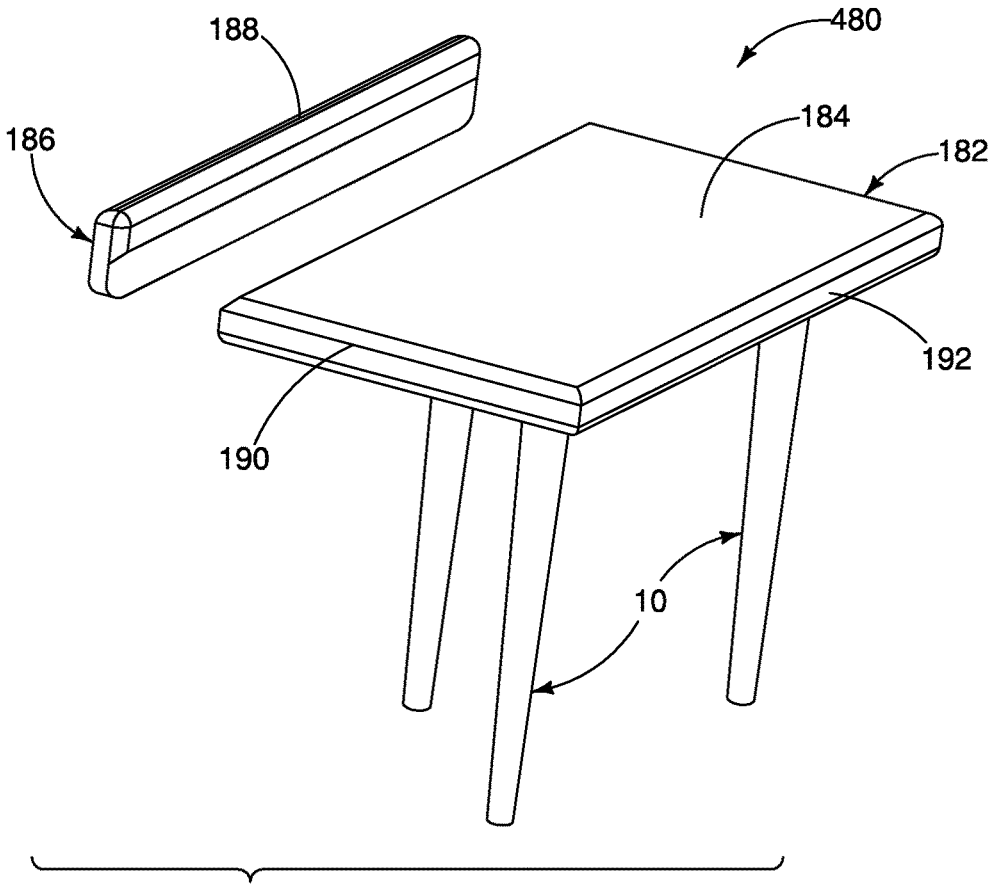
FIG. 22 is an exemplary embodiment of a support structure for an urn according to various embodiments of the invention.

Referring to FIG. 22, another exemplary embodiment of a rectangular urn saddle 480 is illustrated. Similar structures are referenced with the same numbers as used in the previously described rectangular urn saddle. In this embodiment, stop 186 is capable of being selectively detached, and selectively attached, to one side or edge of the square base 182. The connection between stop 186 and square base 182 is provided by respective structure configurations of stop 186 and square base 182 to establish the connection as is understood by those skilled in the art.

Figure 23:
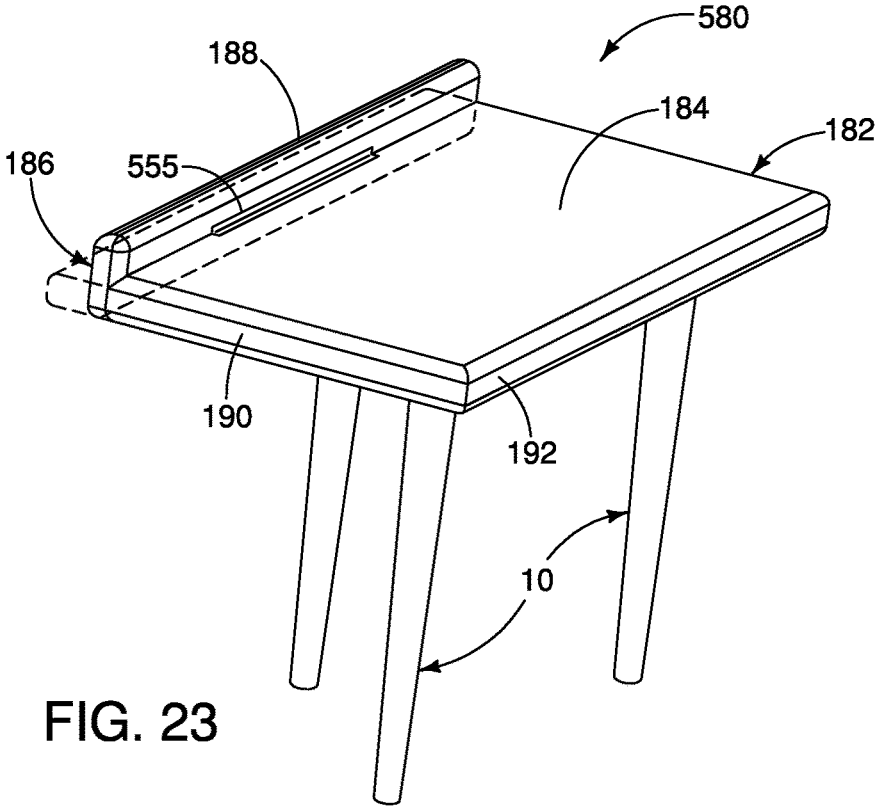
FIG. 23 is an exemplary embodiment of a support structure for an urn according to various embodiments of the invention.

Referring to FIG. 23, another exemplary embodiment of a rectangular urn saddle 580 is illustrated. Similar structures are referenced with the same numbers as used in the previously described rectangular urn saddle. In this embodiment, stop 186 is capable of pivoting relative to the square base 182. The pivoting capability is provided by a bearing 555 between the stop 186 and the square base 182. By pivoting stop 186 approximately 90 degrees away from the square base 182 establishes a coplanar surface between stop 186 and square base 182 thereby increasing the surface area of the support surface provided by square base 182.

In one of various aspects of the inventions, it should be understood that exemplary rectangular urn saddles disclosed herein can be composed of plastic and produced by a method of plastic injection molding. Exemplary plastics include thermoplastics, thermosetting plastics and similar materials which can be characterized as being ductile and/or malleable which provides the capability of being molded into various forms and then hardened, ultimately to be configured as a rectangular urn saddle 180. Furthermore, these plastic materials can be generally characterized by any of various nonmetallic compounds, synthetically produced, usually from organic compounds by polymerization, or formed into pliable sheets or films, fibers, flexible or hard foams. Exemplary plastic materials include polystyrene, acrylonitrile butadiene styrene (ABS), polyamide, polypropylene, polyethylene, and polyvinyl chloride (PVC). Other exemplary nonmetallic compounds include spun glass or fiberglass which is a composite of extremely fine fibers of glass combined with polymers and epoxies.

Other compositions for any one of the embodiments for bases are contemplated such as metals or similar materials. Exemplary metals or similar material include tin, iron, aluminum, zinc, brass, gold, silver, bronze, copper, and alloys of any one metal or any combination of the metals such as steel, stainless steel, etc. The metals or similar material can be characterized as being ductile and/or malleable. Being ductile and malleable allows for the metal or similar material to be molded into various forms and then hardened, ultimately to be configured as a rectangular urn saddle 180. Still further, an exemplary rectangular urn saddle 180 can be composed of wood or ceramic materials.

Referring to FIGS. 24-28, a method is illustrated and described using various components of the inventions described herein for ultimately presenting a funeral display/arrangement that includes a circular urn.

Figure 24:
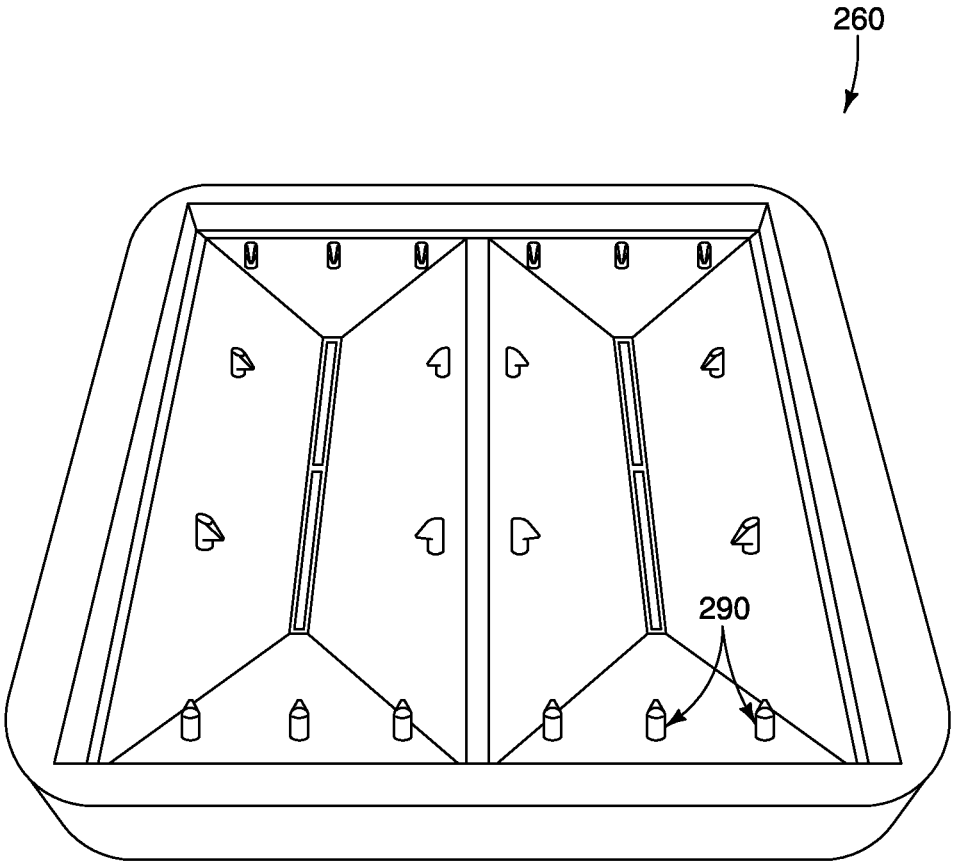
FIG. 24 is a perspective view of a first method step for supporting an urn according to various embodiments of the invention.

Referring to FIG. 24, base 260 described previously is presented. It should be understood that any of the bases described in this document can be provided for this method.

Figure 25:
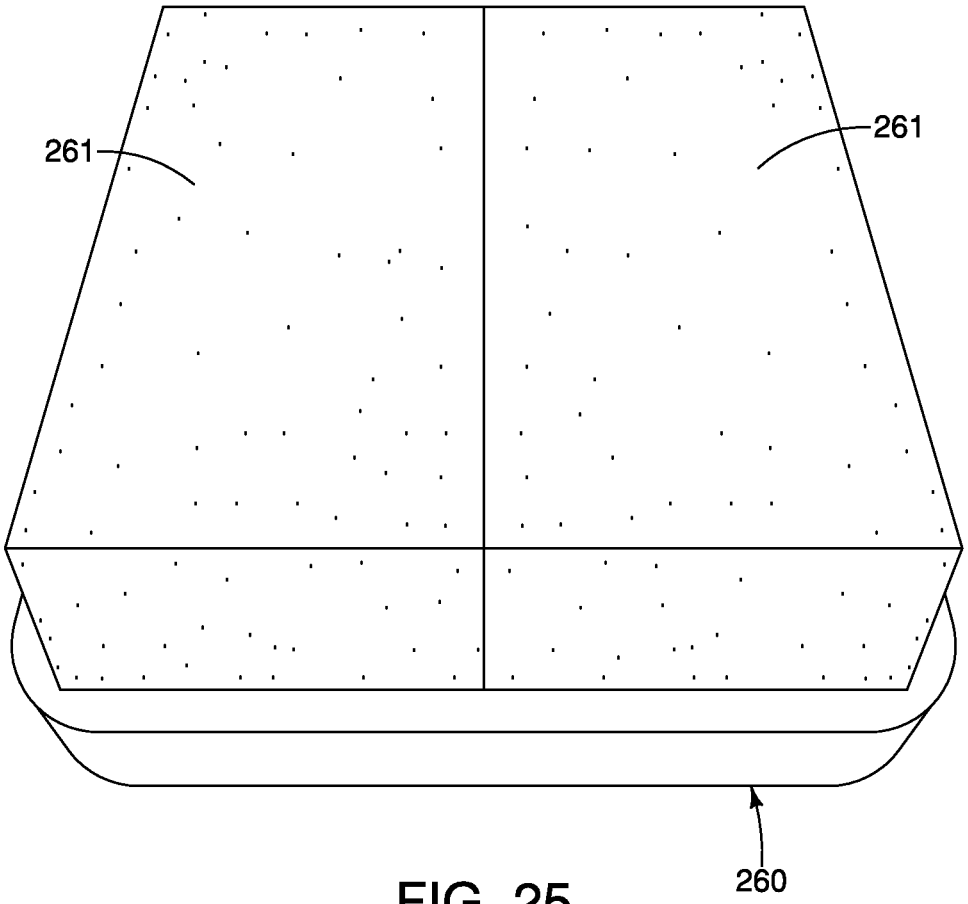
FIG. 25 is a perspective view of a second method step following the method step of FIG. 24.

Referring to FIG. 25, a foam structure (foam material or porous structure or porous material) 261, such as a wet floral foam used in floral displays, is provided in each recess of base 260. The foam structure 261 is pressed (forced) downward toward the base 260 so that the spikes 290 (seen in FIG. 24) pierce and enter the body of the foam structure 261 thereby securing the foam structure 261 onto the base 260. While two foam structures 261 are shown, a single foam structure could be provided that has the same dimensions as foam structure 261, or larger dimensions.

Figure 26:
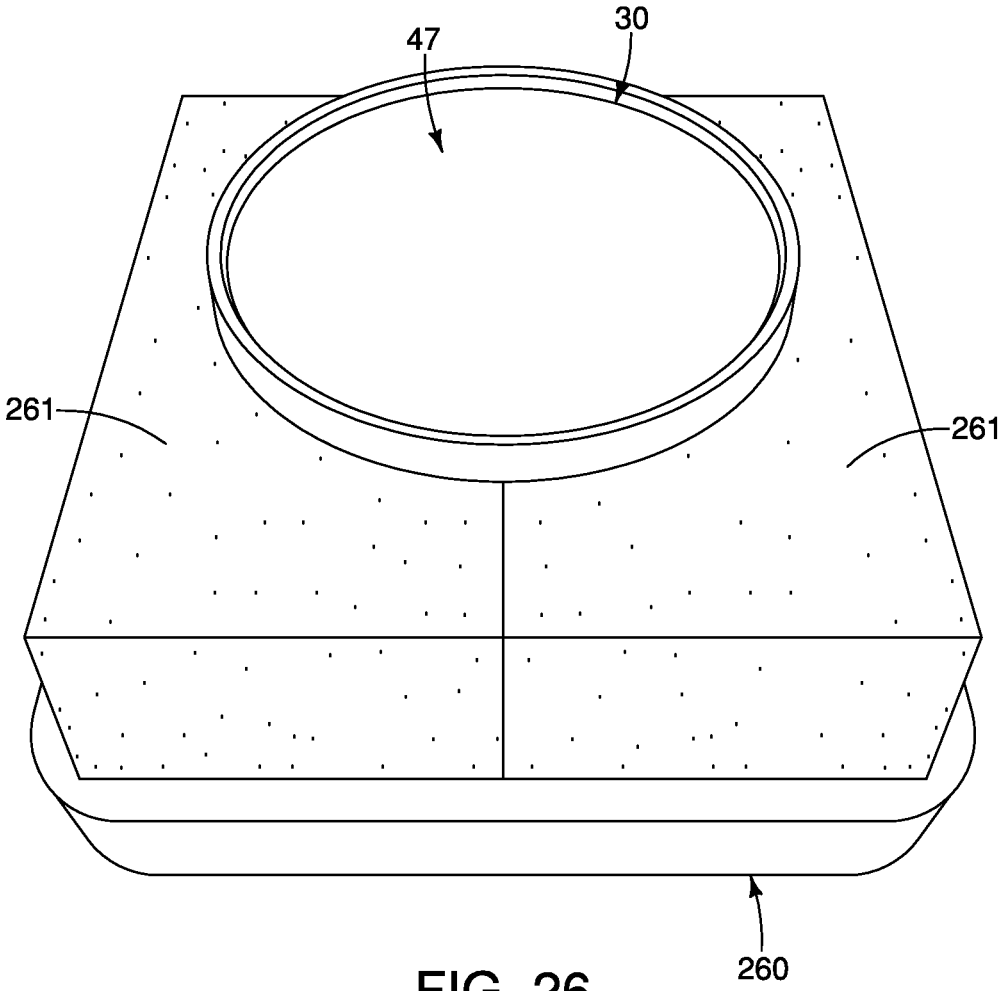
FIG. 26 is a perspective view of a third method step following the method step of FIG. 25.

Referring to FIG. 26, a circular urn saddle 30 is provided and the legs of the circular urn saddle 30 are pressed into the foam structures 261. It should be understood that any of the circular urn saddles discussed in this document can be used. In fact, this circular urn saddle 30 includes one of the circular plates (platforms) 47 positioned on top of a dimensionally accommodating circular ridge to provide an increase in surface area of the support surface.

Figure 27:
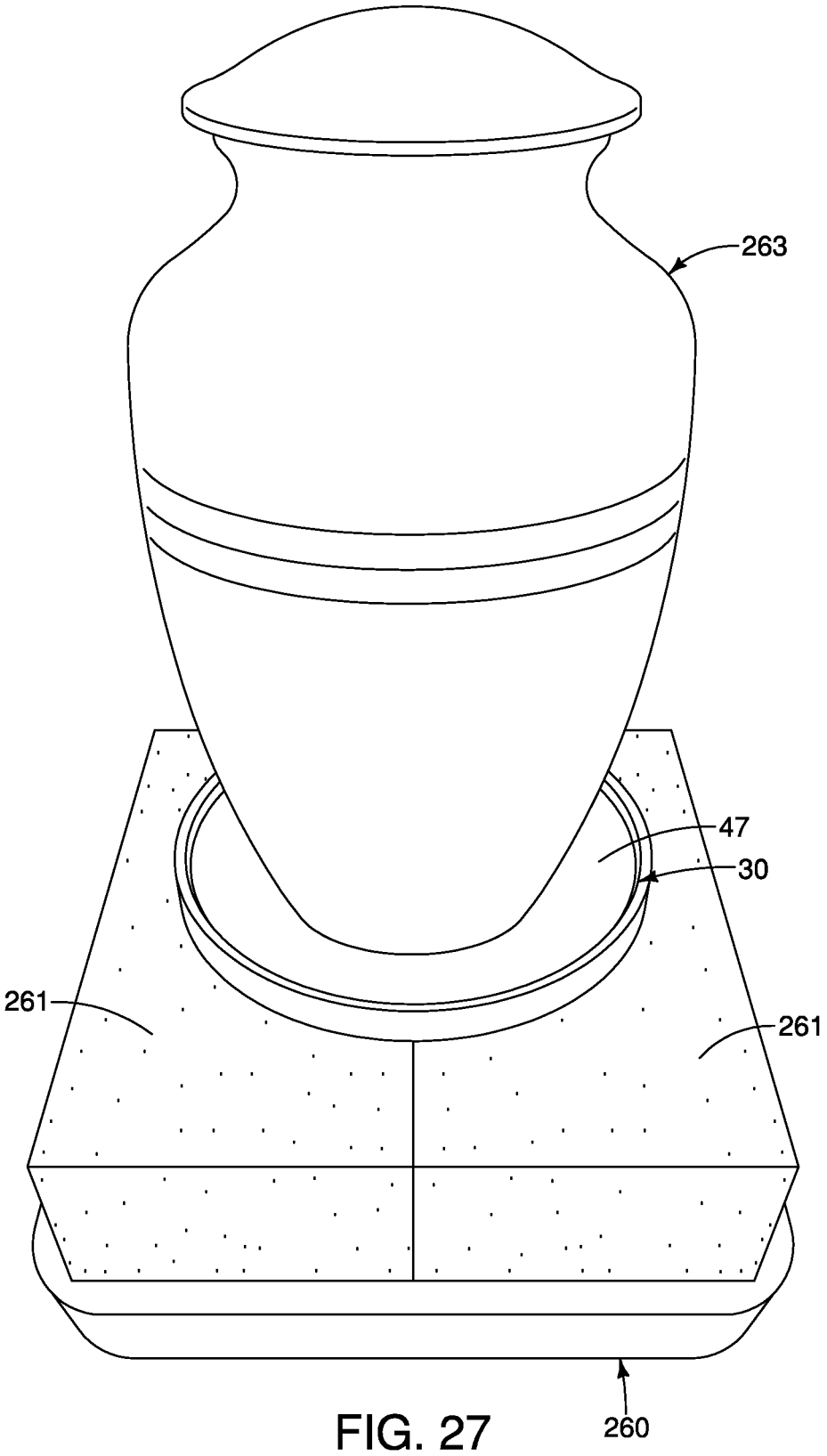
FIG. 27 is a perspective view of a fourth method step following the method step of FIG. 26.

Referring to FIG. 27, an urn 263 is placed on the circular plate 47 of the circular urn saddle 30.

Figure 28:
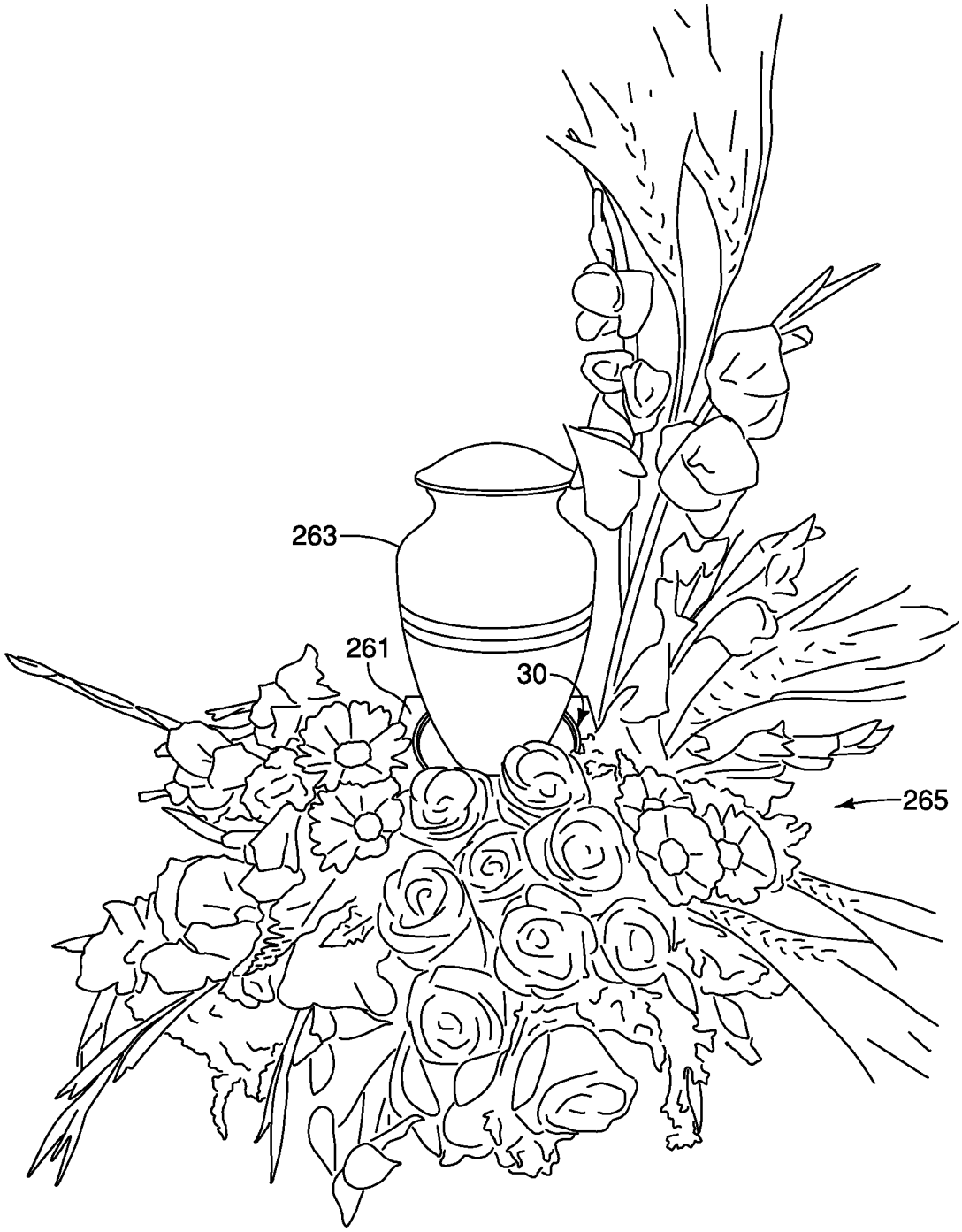
FIG. 28 is a perspective view of a fifth method step following the method step of FIG. 27.

Referring to FIG. 28, a floral arrangement 265 is configured and presented around the urn 263 wherein the stems of the floral arrangement 265 are pressed into the foam structure 261. The base with the foam structure 261, with the circular urn saddle 30, with the urn 263 and with the floral arrangement 265 can be placed on any level surface for ultimate support.

Referring to FIGS. 29-32, another method is illustrated using various components of the inventions described herein for ultimately presenting a funeral display that includes a rectangular urn.

Figure 29:
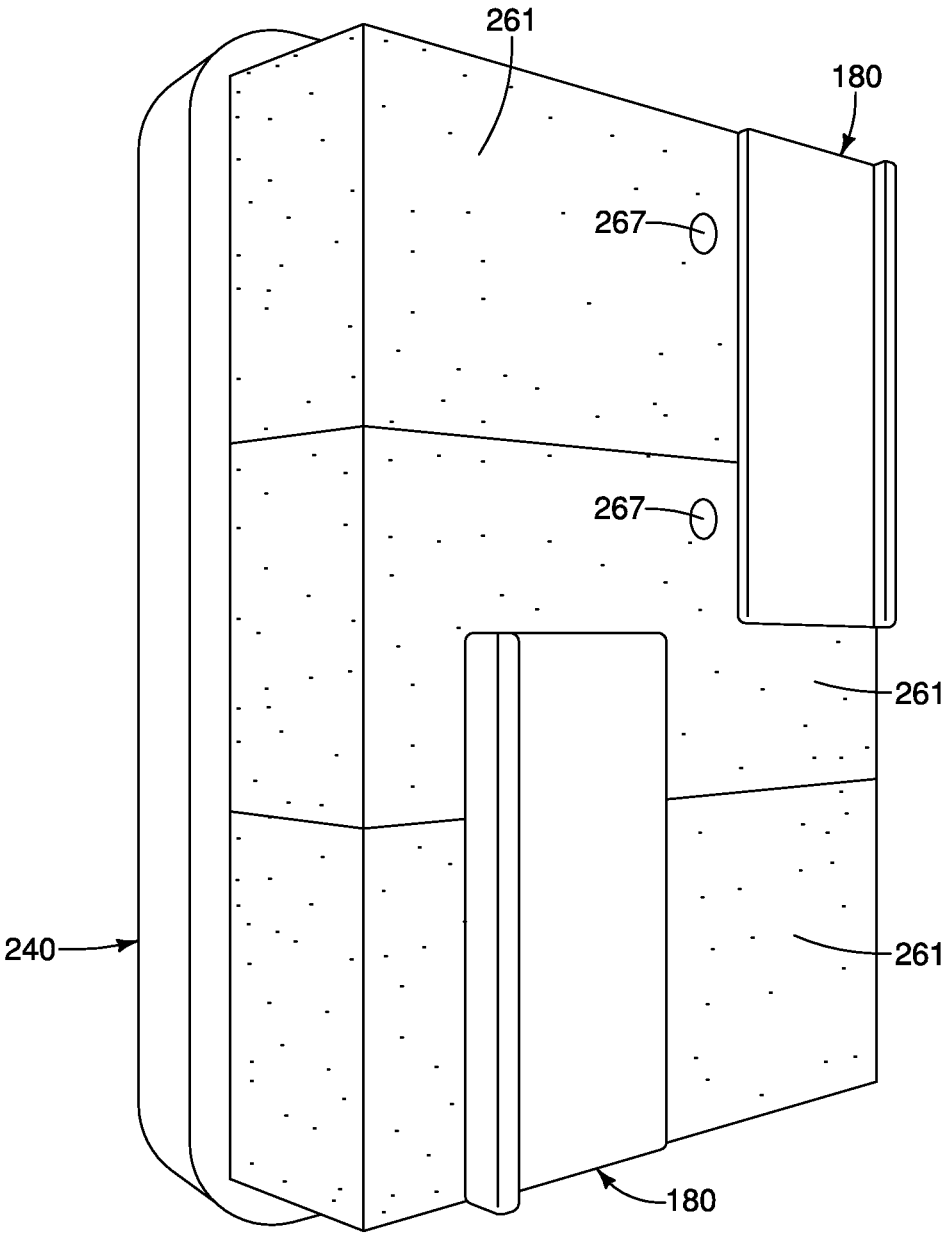
FIG. 29 is a perspective view of a first method step for supporting an urn according to various embodiments of the invention.

Referring to FIG. 29, an exemplary base 240 is presented. The base can be any of the embodiments of bases described in this document. Moreover, a foam structure 261, such as a wet or silk/dry floral foam used in a floral display, is provided in each recess of the base 240 and pressed down so that the spikes (not seen) will enter the body of the foam structure 261 thereby securing the foam structure 261 onto the base 240. Still further, a pair of rectangular urn saddles 180 is provided and the legs of the rectangular urn saddles 180 are pressed into the foam structure 261. It should be understood that any of the rectangular urn saddles discussed in this document can be used. While this display includes two rectangular urn saddles 180, more or less number of rectangular urn saddles can be used as needed.

Figure 30:
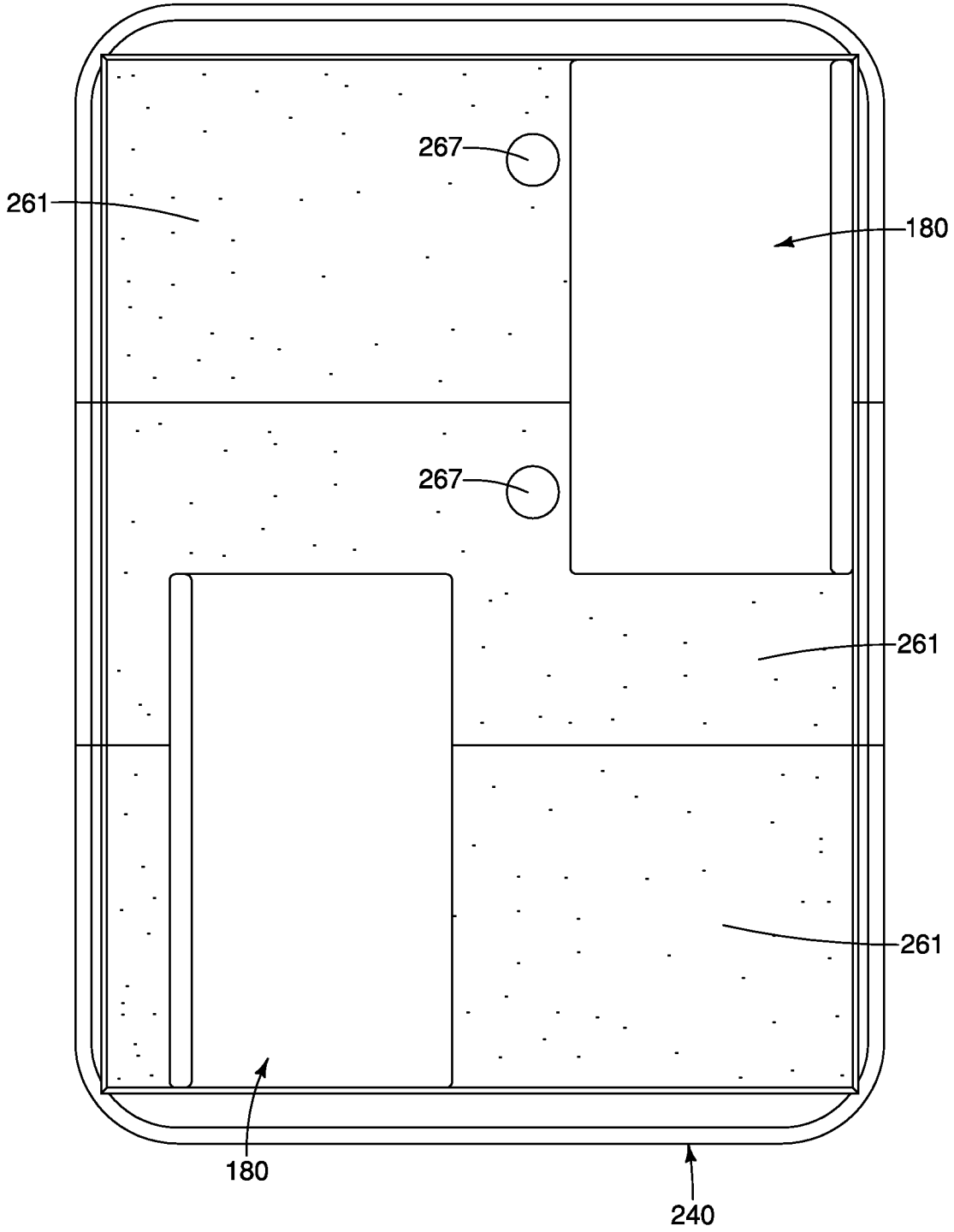
FIG. 30 is a top view of the first method step of FIG. 29.

Referring to FIG. 30, a top view of FIG. 29 is illustrated.

Figure 31:
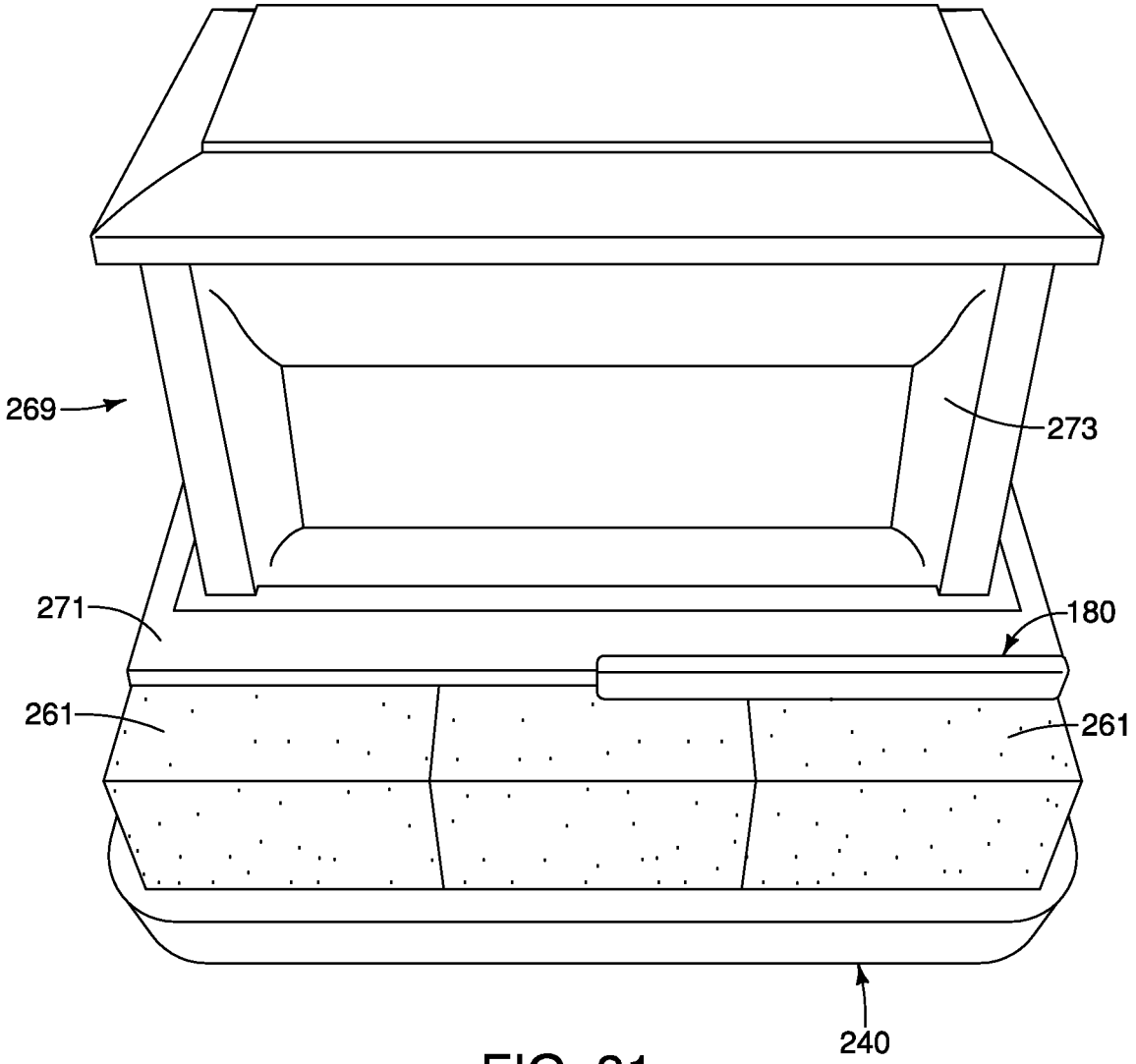
FIG. 31 is a perspective view of a second method step following the method step of FIG. 29.

Referring to FIG. 31, a floor structure 271 of a rectangular urn 269 is placed on the pair of rectangular urn saddles 180. Rectangular urn 269 has a front face 273

Figure 32:
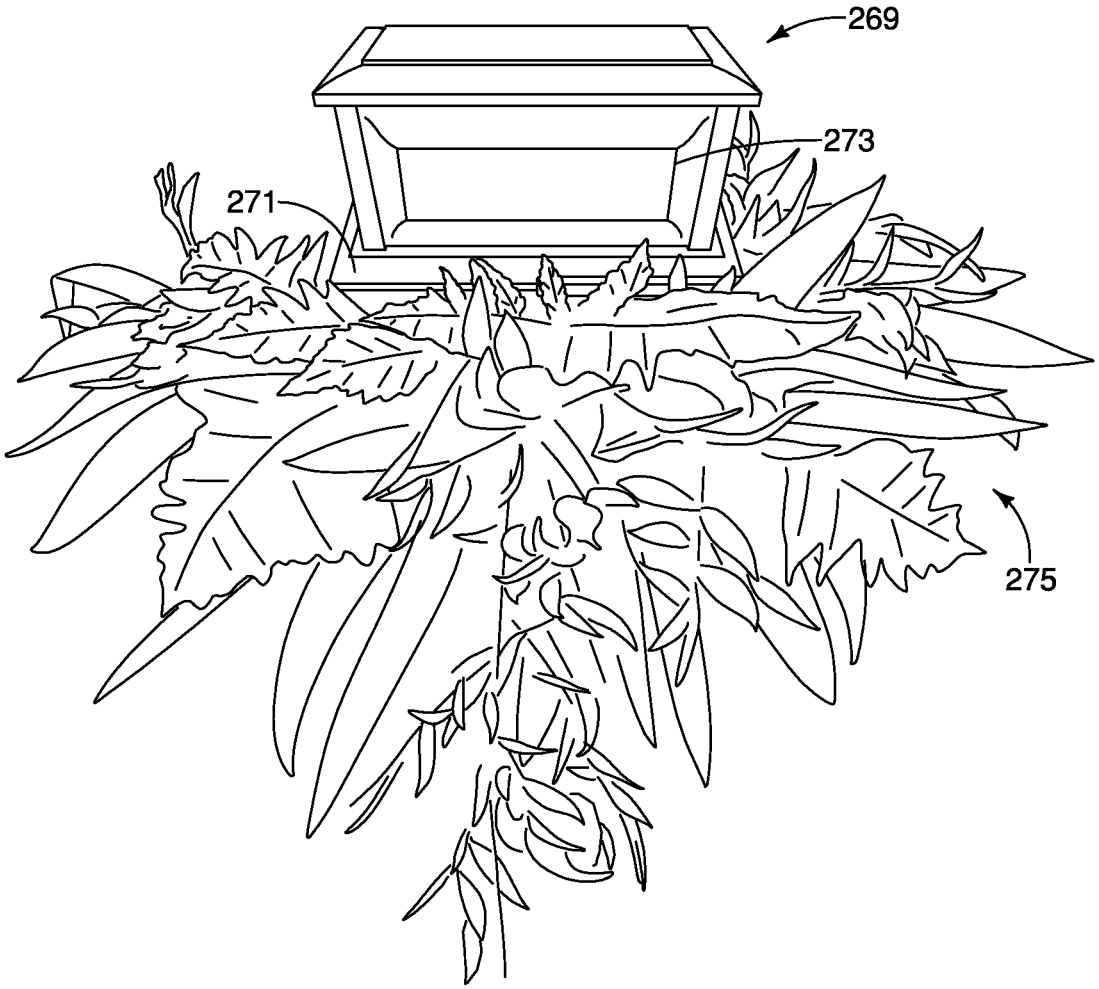
FIG. 32 is a perspective view of a third method step following the method step of FIG. 31.

Referring to FIG. 32, a floral arrangement 275 is configured and presented around the urn 269 wherein the stems of the floral arrangement 275 are pressed into the foam structure 261. The base 240 with the foam structure 261, with the pair of rectangular urn saddles 180, with the urn 269 and with the floral arrangement 275 can be placed on any level surface for ultimate support.

Figure 33:
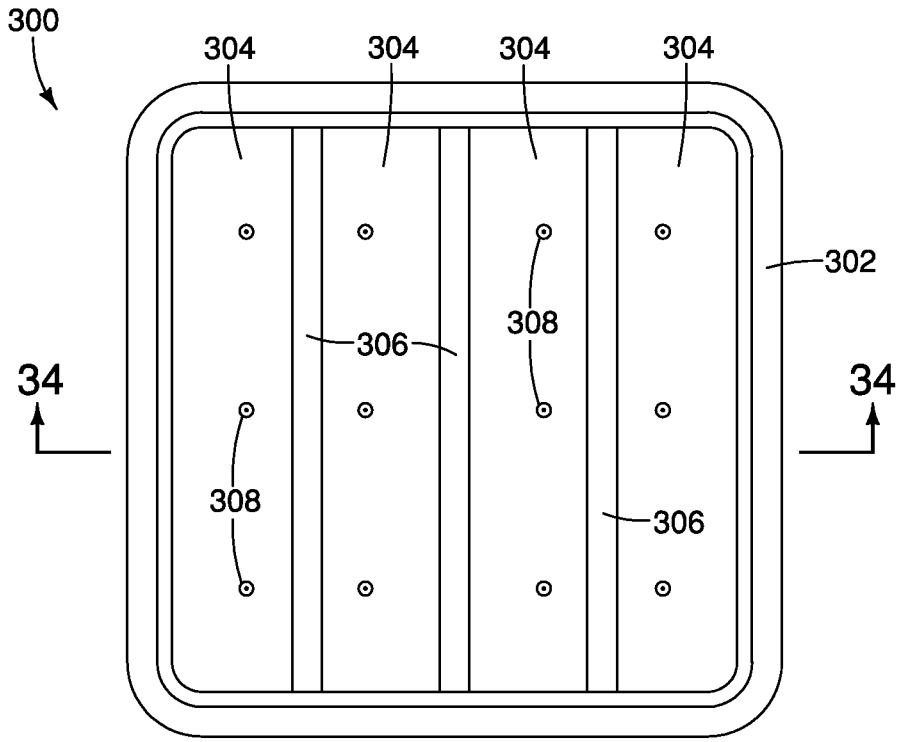
FIG. 33 is a top view of an exemplary embodiment of a base for a support structure of an urn according to various embodiments of the invention.
Figure 34:
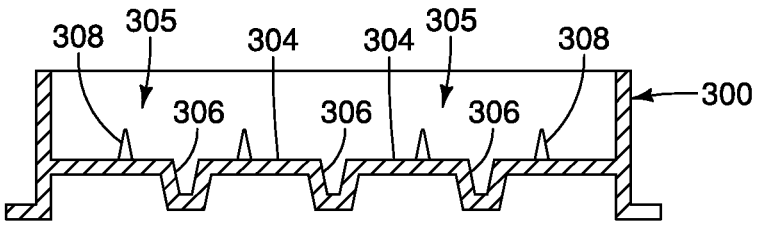
FIG. 34 is a sectional side view of the base of FIG. 33.

Referring to FIGS. 33-34, another exemplary base (or receptacles) 300 is illustrated. Similar structures are referenced with the same numbers as used in the previously described bases. Base 300 includes a periphery ledge 302 surrounding a substantially square-shaped interior cavity 305. The interior cavity 305 of base 300 includes a lowermost surface (floor) 304 having recessed grooves (drainage slots or drainage grooves) 306 extending linearly across one entire dimension of the lowermost surface 304. A plurality of spikes 308 extend upwardly from the lowermost surface 304. In this embodiment, each portion of the lowermost surface 304 between recessed grooves 306 has three spikes 308. A larger number of spikes 308, or a less number of spikes 308, for base 300 are contemplated.

Figure 35:
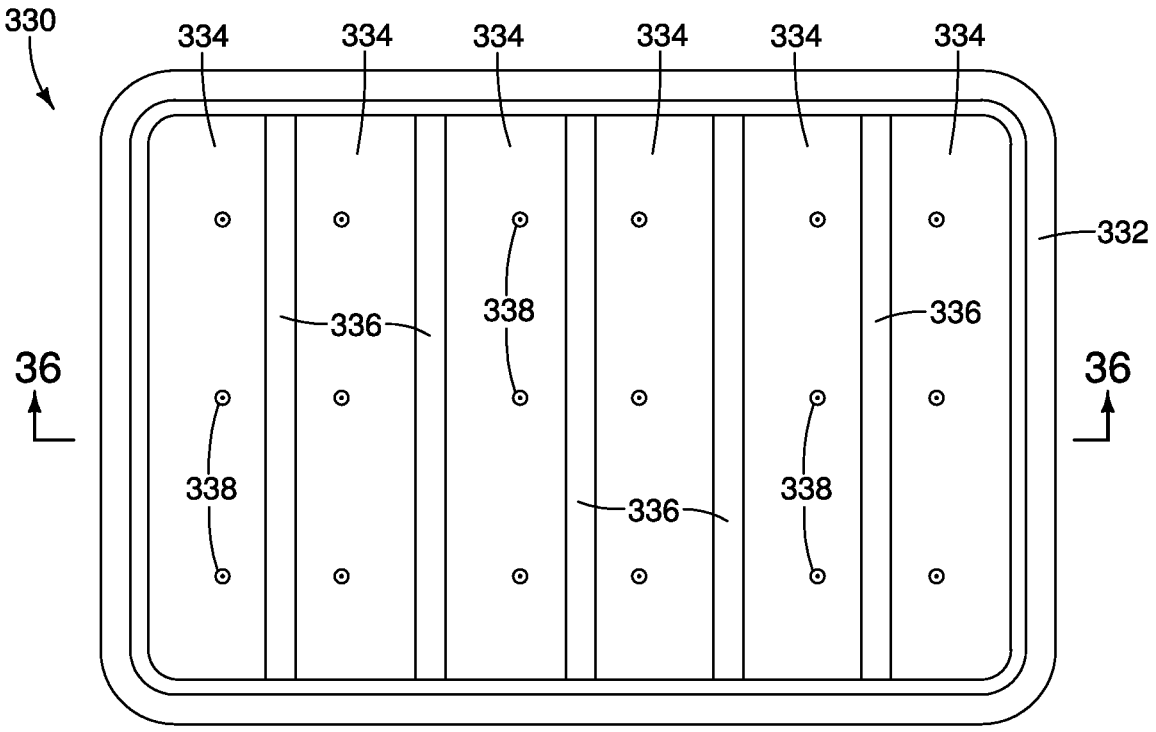
FIG. 35 is a top view of an exemplary embodiment of a base for a support structure of an urn according to various embodiments of the invention.
Figure 36:
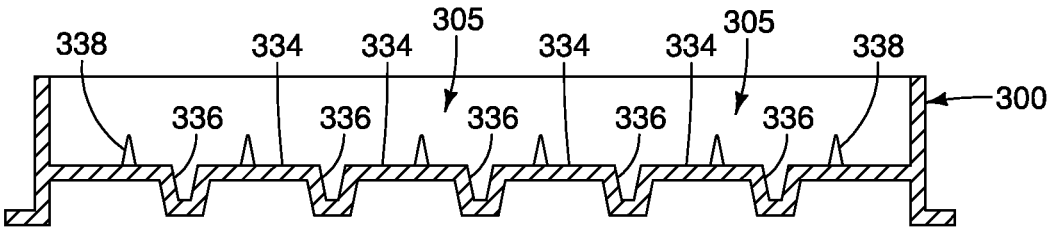
FIG. 36 is a sectional side view of the base of FIG. 35.

Referring to FIGS. 35-36, another exemplary base (or receptacles) 330 is illustrated. Similar structures are referenced with the same numbers as used in the previously described bases. Base 330 includes a periphery ledge 332 surrounding a substantially rectangular-shaped interior cavity 305. The interior cavity 305 of base 330 includes a lowermost surface (floor) 334 having recessed grooves 336 extending linearly across one entire dimension of the lowermost surface 334. A plurality of spikes 338 extend upwardly from the lowermost surface 334. In this embodiment, each portion of the lowermost surface 334 between recessed grooves 336 has three spikes 338. A larger number of spikes 338, or a less number of spikes 338, for base 330 are contemplated.

It should be understood that for all spikes (hooks) discussed in this document for exemplary bases, the spikes can rest in openings of bases allowing for the capability of the spikes to be selectively removed from openings or selectively provided in openings. Alternatively, for all spikes (hooks) discussed in this document, the spikes can be permanently secured to the bases. Exemplary methods for permanent securement is as an integral structure of the sloping surfaces or by cement/glue provided in openings.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect.

What is claimed is:

1. A method of supporting an urn comprising:

providing a base;

securing a foam material to the base;

securing a support surface to the foam material; and providing the urn upon the support surface.

2. The method of claim 1 wherein the securing of the support surface comprises securing a first support surface to the foam material and securing a second support surface to the foam material and spaced from the first support surface.

3. The method of claim 2 further comprising providing a floral arrangement to at least partially block from view the base and the foam material.

* * * * *